US009195192B2

(12) United States Patent
Hasegawa

(10) Patent No.: US 9,195,192 B2
(45) Date of Patent: Nov. 24, 2015

(54) IMAGE HEATING APPARATUS INCLUDING BELT UNIT CONFIGURED TO HEAT ROTATABLE HEATING MEMBER

(71) Applicant: CANON KABUSHIKI KAISHA, Tokyo (JP)

(72) Inventor: Takuya Hasegawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/032,838

(22) Filed: Sep. 20, 2013

(65) Prior Publication Data

US 2014/0093287 A1 Apr. 3, 2014

(30) Foreign Application Priority Data

Oct. 1, 2012 (JP) ..... 2012-219160

(51) Int. Cl.
*G03G 15/20* (2006.01)

(52) U.S. Cl.
CPC ..... *G03G 15/2064* (2013.01); *G03G 15/2017* (2013.01); *G03G 2215/00156* (2013.01); *G03G 2215/2019* (2013.01)

(58) Field of Classification Search
CPC ..... G03G 15/2064; G03G 15/2017
USPC ..... 399/328
See application file for complete search history.

(56) References Cited

U.S. PATENT DOCUMENTS 7,430,393 B2 9/2008 Kuroki et al.
7,616,920 B2 11/2009 Matsumoto et al.
7,684,746 B2 3/2010 Asakura et al.
7,711,306 B2 5/2010 Kagawa
8,027,602 B2 9/2011 Kuroki et al.
2007/0189817 A1 8/2007 Kagawa
2007/0212094 A1 9/2007 Asakura et al.
2008/0003028 A1 1/2008 Kuroki et al.
2008/0317525 A1 12/2008 Kuroki et al.
2009/0317115 A1 12/2009 Motoyama (Continued)

FOREIGN PATENT DOCUMENTS

CN 101017358 A 8/2007
CN 101038470 A 9/2007

(Continued)

OTHER PUBLICATIONS

Pending, U.S. Appl. No. 14/030,208, filed Sep. 17, 2013, Takuya Hasegawa.

(Continued)

*Primary Examiner* — Quana M Grainger
(74) *Attorney, Agent, or Firm* — Fitzpatrick, Cella, Harper & Scinto

(57) ABSTRACT

An image heating apparatus includes: a rotatable heating member; a belt unit including an endless belt and first and second supporting members; a detector; a rotating mechanism; and a displacing mechanism for permitting displacement, with rotation of the belt unit by the rotating mechanism, of the first supporting member in a direction of equalizing forces urging the belt toward the rotatable heating member by the first supporting member at widthwise ends of the belt, and for permitting displacement, with rotation of the belt unit by the rotating mechanism, of the second supporting member in a direction of equalizing forces urging the belt toward the rotatable heating member by the second supporting member at the widthwise ends of the belt.

37 Claims, 23 Drawing Sheets

(56) References Cited

U.S. PATENT DOCUMENTS

| | | | | |
|---|---|---|---|---|
| 2011/0142496 | A1 | 6/2011 | Kameda | |
| 2013/0051875 | A1* | 2/2013 | Takahashi | 399/329 |
| 2013/0209145 | A1 | 8/2013 | Hasegawa | |

FOREIGN PATENT DOCUMENTS

| | | | | |
|---|---|---|---|---|
| CN | 101101474 | A | | 1/2008 |
| JP | 2005301044 | A | * | 10/2005 |
| JP | 2007-212896 | A | | 8/2007 |

OTHER PUBLICATIONS

Pending, U.S. Appl. No. 14/091,669, filed Nov. 27, 2013, Takuya Hasegawa.

Pending, U.S. Appl. No. 14/083,994, filed Nov. 19, 2013, Takuya Hasegawa.

Apr. 3, 2015 Decision on Grant in counterpart Russian Patent Application No. 201314393/028(067672) and English translation thereof.

Apr. 3, 2015 Office Action in counterpart Russian Patent Application No. 201314393028(067672) and English translation thereof.

Jul. 3, 2015 Office Action in counterpart Chinese Patent Application No. 201310459645.7 and English translation thereof.

* cited by examiner (a)

(b)

(a)

(b)

(a)

(b)

(a)

(b)

(a)

(b)

IMAGE HEATING APPARATUS INCLUDING BELT UNIT CONFIGURED TO HEAT ROTATABLE HEATING MEMBER

FIELD OF THE INVENTION AND RELATED ART

The present invention relates to an image heating apparatus for heating a toner image on a recording material. This image heating apparatus is usable in an image forming apparatus, such as a printer, a copying machine, a facsimile machine or a multi-function machine having a plurality of functions of these machines, using, e.g., an electrophotographic type or an electrostatic recording type.

Various image forming apparatuses have been conventionally known, but those of the electrophotographic type have come into wise use in general. Such image forming apparatuses are required to provide high productivity (the print number per unit time) with respect to various recording materials (sheets) such as thick paper.

Incidentally, in the image forming apparatus of the electrophotographic type as described above, particularly in order to improve the productivity with respect to the thick paper having a large basis weight, speed-up of a fixing speed of a fixing device or apparatus (image heating apparatus) is required. However, in the case of the thick paper, compared with the case of thin paper, heat in a large amount is taken from the fixing device with sheet passing, and therefore a heat quantity required for fixing becomes large. For that reason, in the case of the thick paper, a coping method in which the productivity is lowered (by decreasing the fixing speed or the print number per unit time) has been known.

As a coping method in which the productivity is not lowered with respect to the thick paper, an externally heating type (method) in which a member is contacted to an outer surface of a fixing roller (rotatable heating member) to maintain an outer surface temperature of the fixing roller has been devised. As an example of such an externally heating type, the following type in which the member has large contact area with the fixing roller and has a high fixing roller temperature maintaining performance has been proposed. The type is a type using an externally heating belt (endless belt) rotatably stretched two supporting rollers (Japanese Laid-Open Patent Application (JP-A) 2007-212896).

However, in the type described in JP-A 2007-212896, it is actually difficult to assemble the externally heating belt with the two supporting rollers with high accuracy of parallelism between the two supporting rollers and to maintain the parallelism with high accuracy. As a result, when the parallelism between the two supporting rollers is not ensured, the externally heating belt is shifted in a widthwise direction thereof, so that there is a fear that travelling stability of the externally heating belt is impaired.

Therefore, with respect to such a fear, it would be considered that a method in which the (lateral) shift of the externally heating belt is controlled by inclining one of the supporting rollers with respect to the other supporting roller is used, but in the case of the externally heating belt performing a function of heating the fixing roller, it is difficult to employ this method.

This is because in the cases of this method, a constitution in which an end side of one of the supporting roller with respect to an axial direction is displaced with respect to another end side of the one of the supporting rollers is employed, but there is a fear that a part of a region where the externally heating belt is to be contacted to the fixing roller is separated (spaced) from the fixing roller by displacement of this one of the supporting roller. As a result, a function of the externally heating belt for heating the fixing roller is impaired, so that improper fixing is invited.

SUMMARY OF THE INVENTION

A principal object of the present invention is to provide an image heating apparatus capable of improving not only travelling stability of an endless belt but also a contact state of the belt with a rotatable heating member.

These and other objects, features and advantages of the present invention will become more apparent upon a consideration of the following description of the preferred embodiments of the present invention taken in conjunction with the accompanying drawings.

Figure 4:
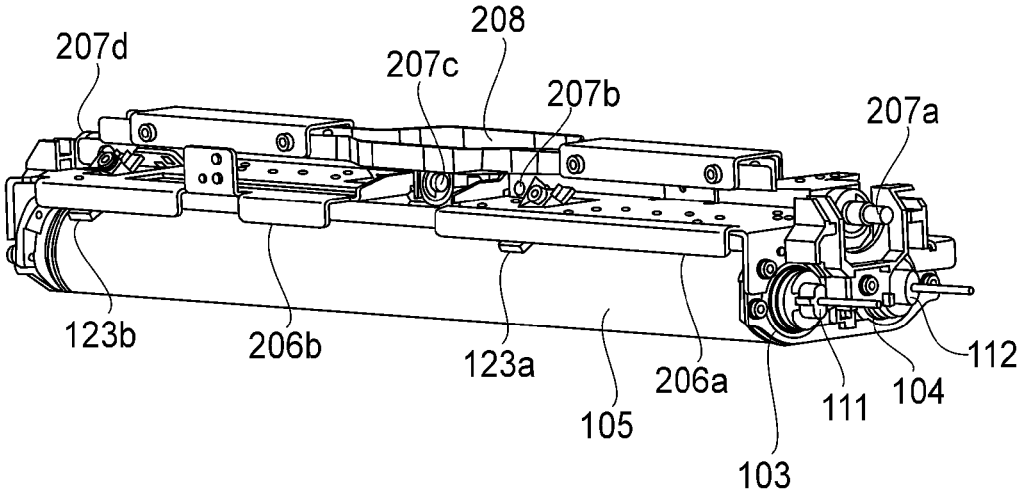
Figure 4:
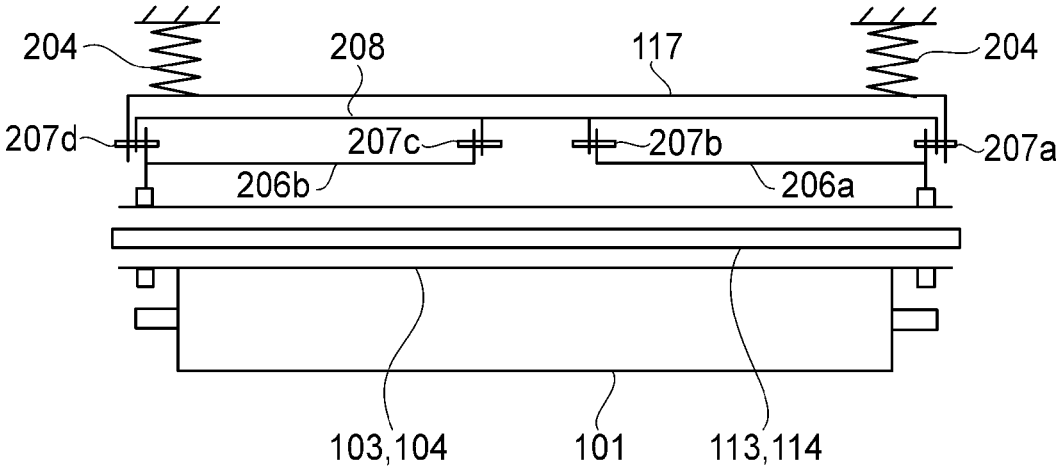

Parts (a) and (b) of FIG. 4 are a perspective view and a mechanism view, respectively, of the externally heating unit.

Figure 5:
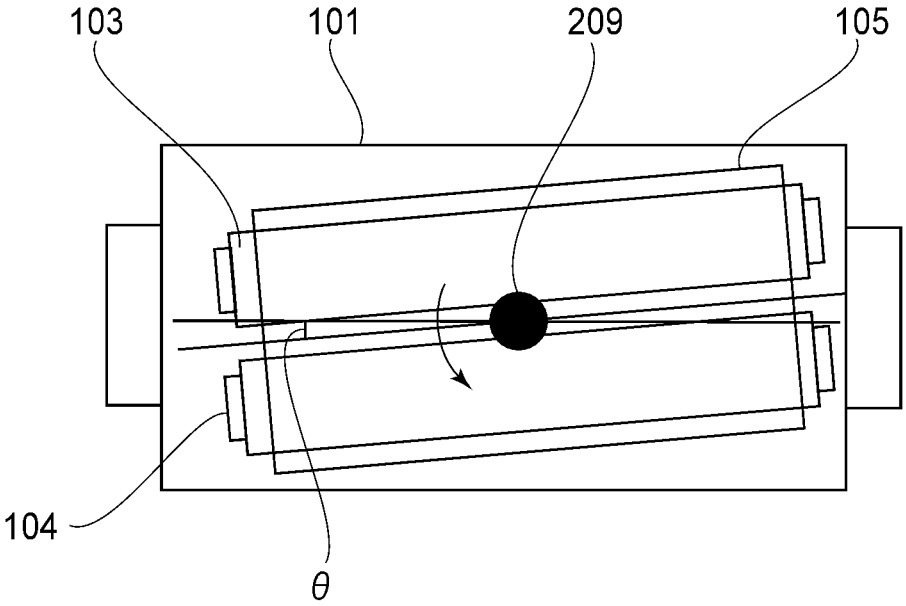

FIG. 5 is an illustration of a steering angle θ with steering control.

Figure 6:
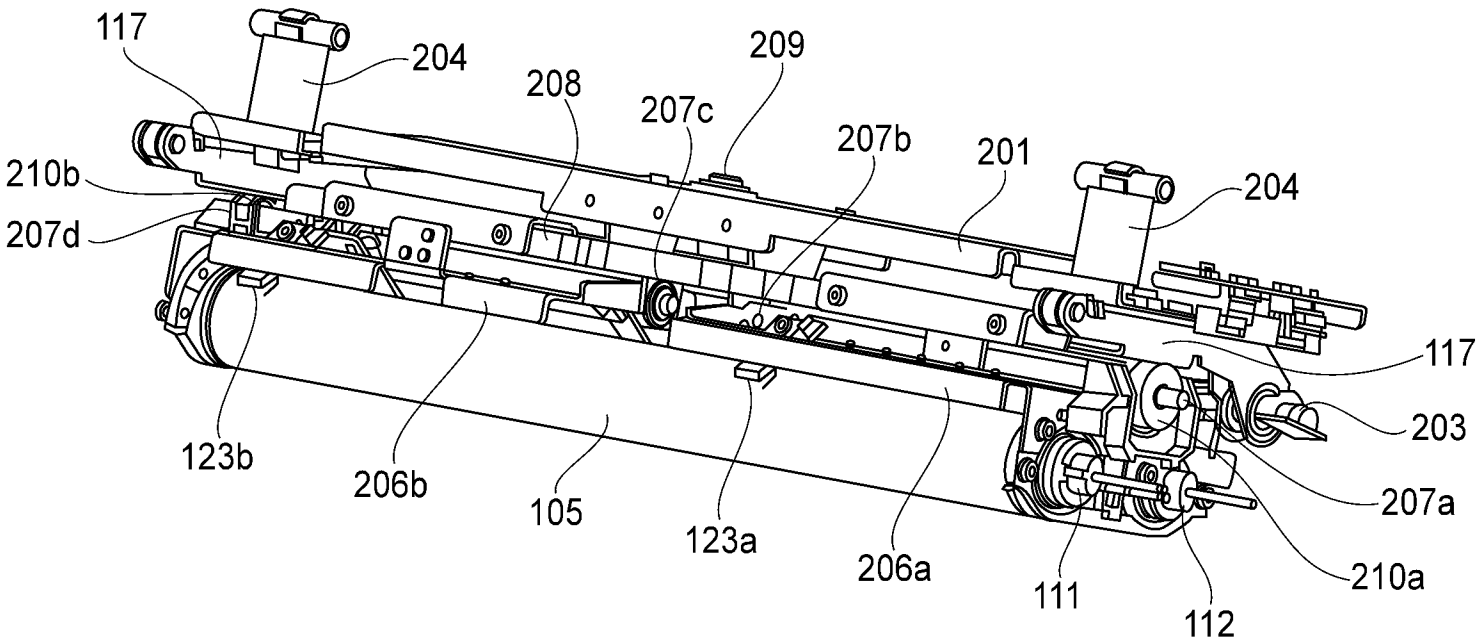

FIG. 6 is an illustration of a structure of the externally heating unit supported by a steering mechanism.

Figure 7:
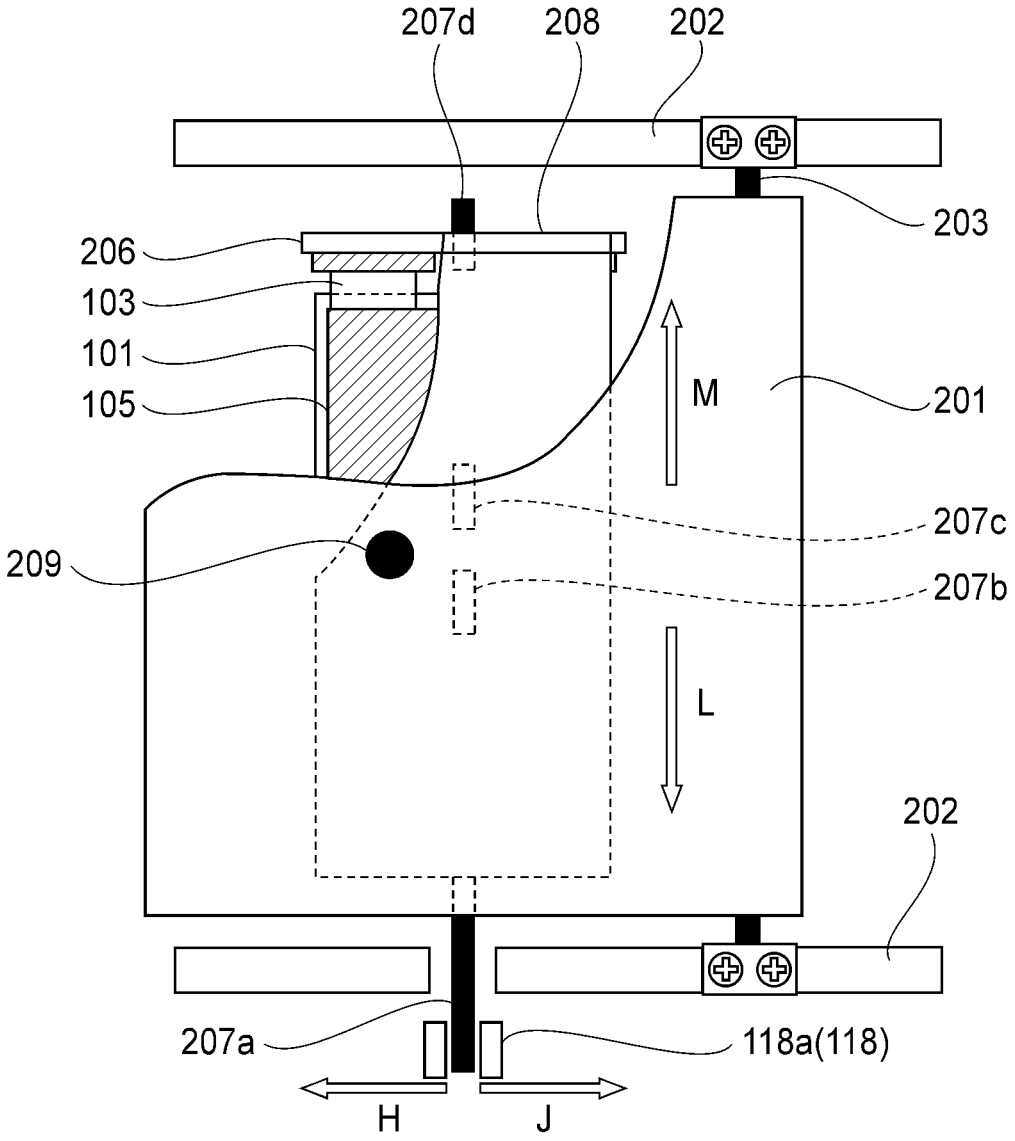

FIG. 7 is an illustration of the steering mechanism.

Figure 8:
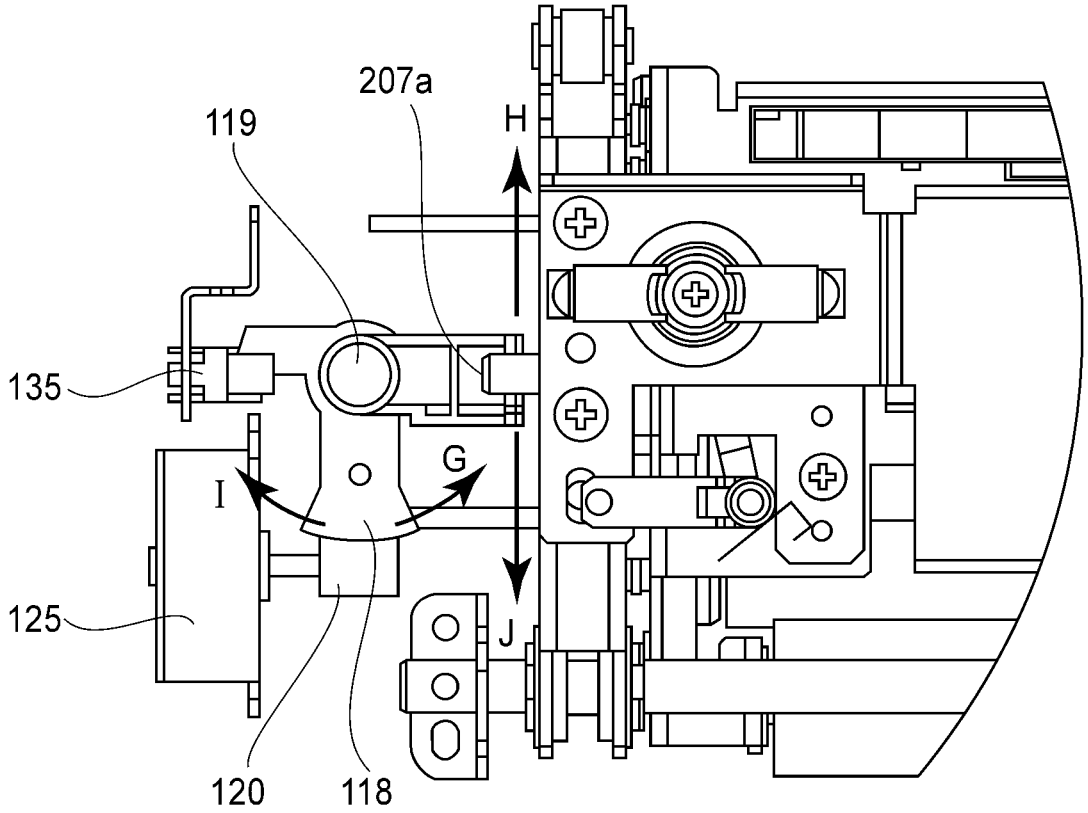

FIG. 8 is an illustration of a driving portion of the steering mechanism.

Figure 9:
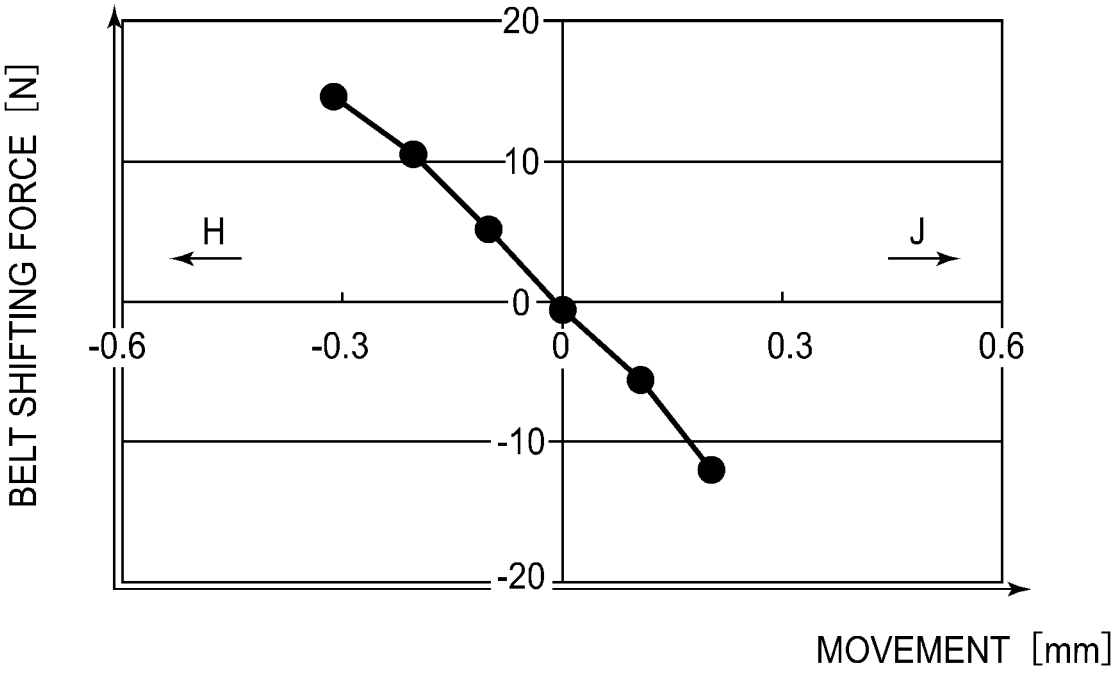

FIG. 9 is a graph showing a relationship between a movement amount of a supporting shaft and a shifting force of the externally heating belt.

Figure 10:
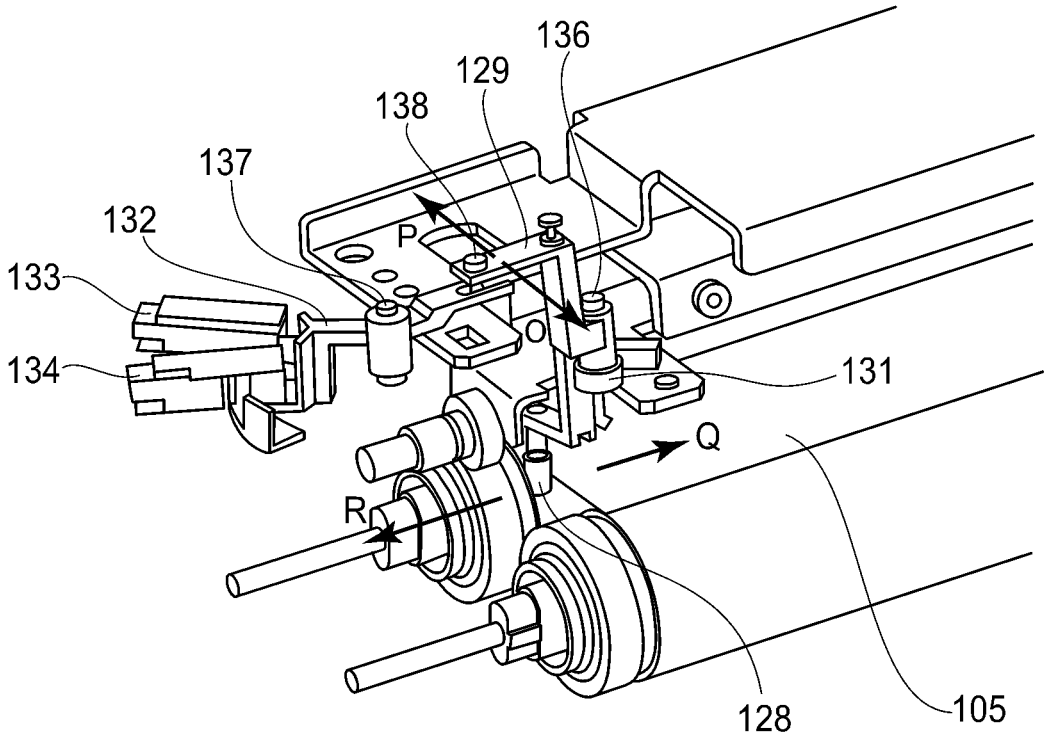

FIG. 10 is an illustration of an arrangement of a belt shift amount detecting sensor.

Figure 11:
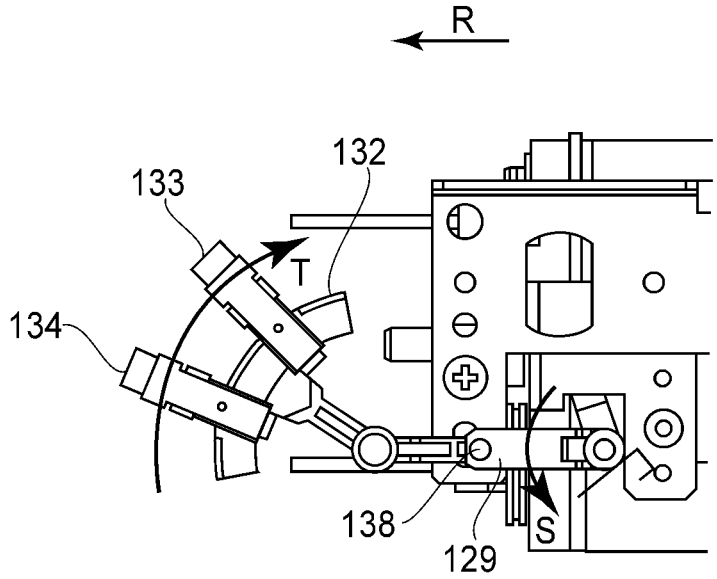
Figure 11:
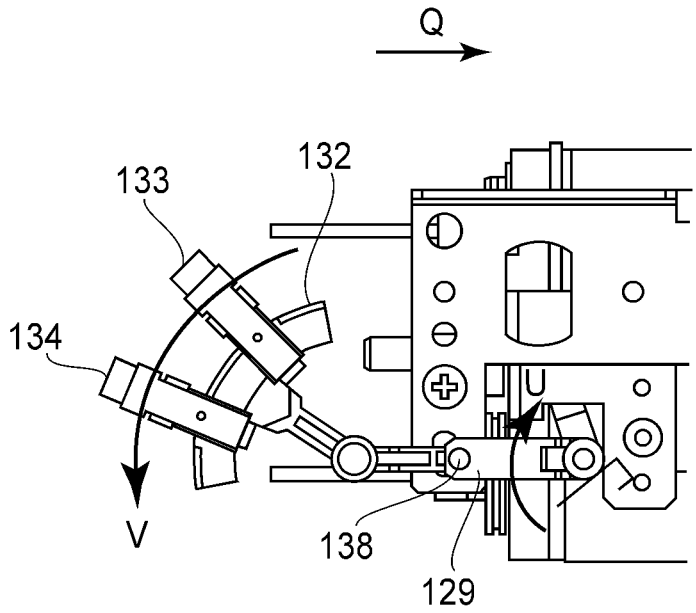

Part (a) of FIG. 11 is an illustration of a rotational direction of a sensor flag in the case where the belt is shifted in a longitudinal front side, and (b) of FIG. 11 is an illustration of the rotational direction of the sensor flag in the case where the belt is shifted in a longitudinal rear side.

Figure 12:
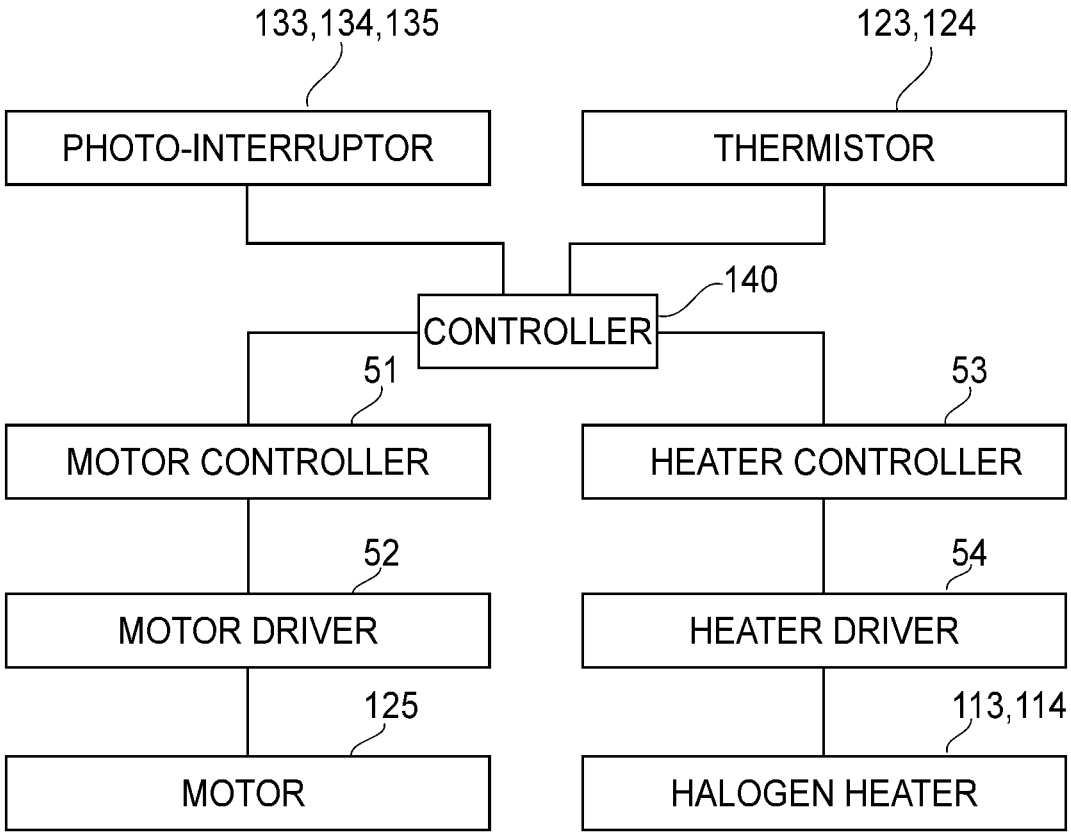

FIG. 12 is a block diagram of a control system of the fixing device.

Figure 13:
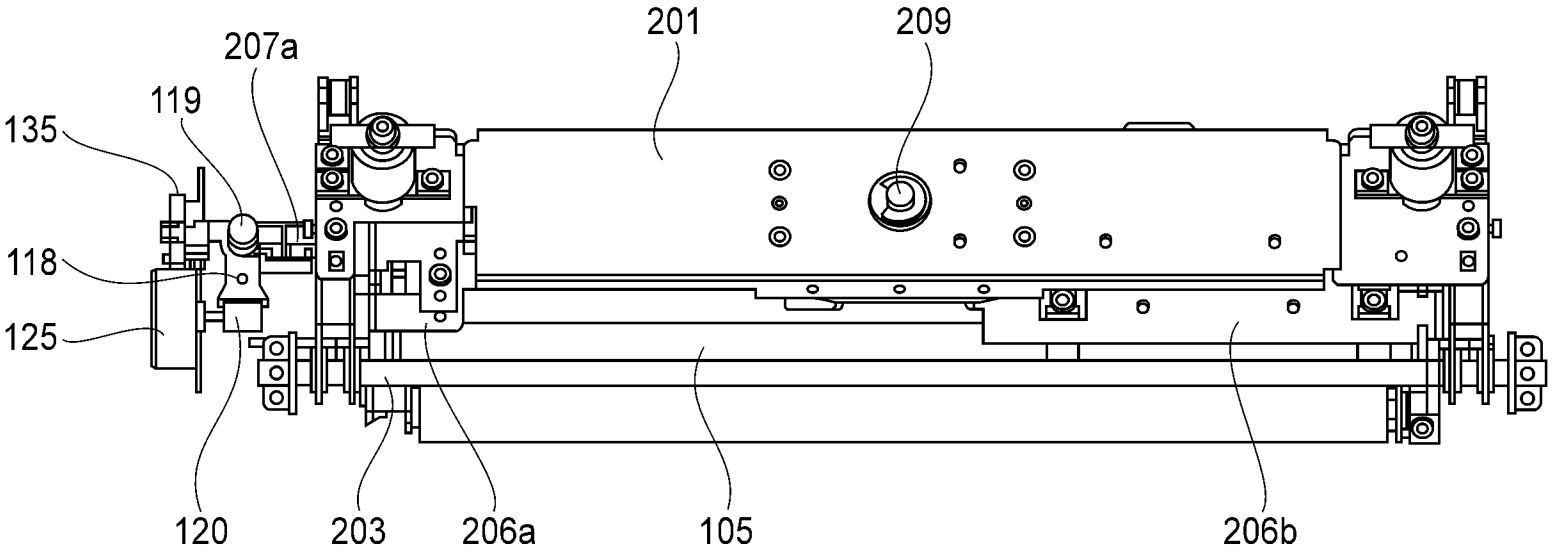

FIG. 13 is an illustration of an arrangement of a home position sensor.

Figure 14:
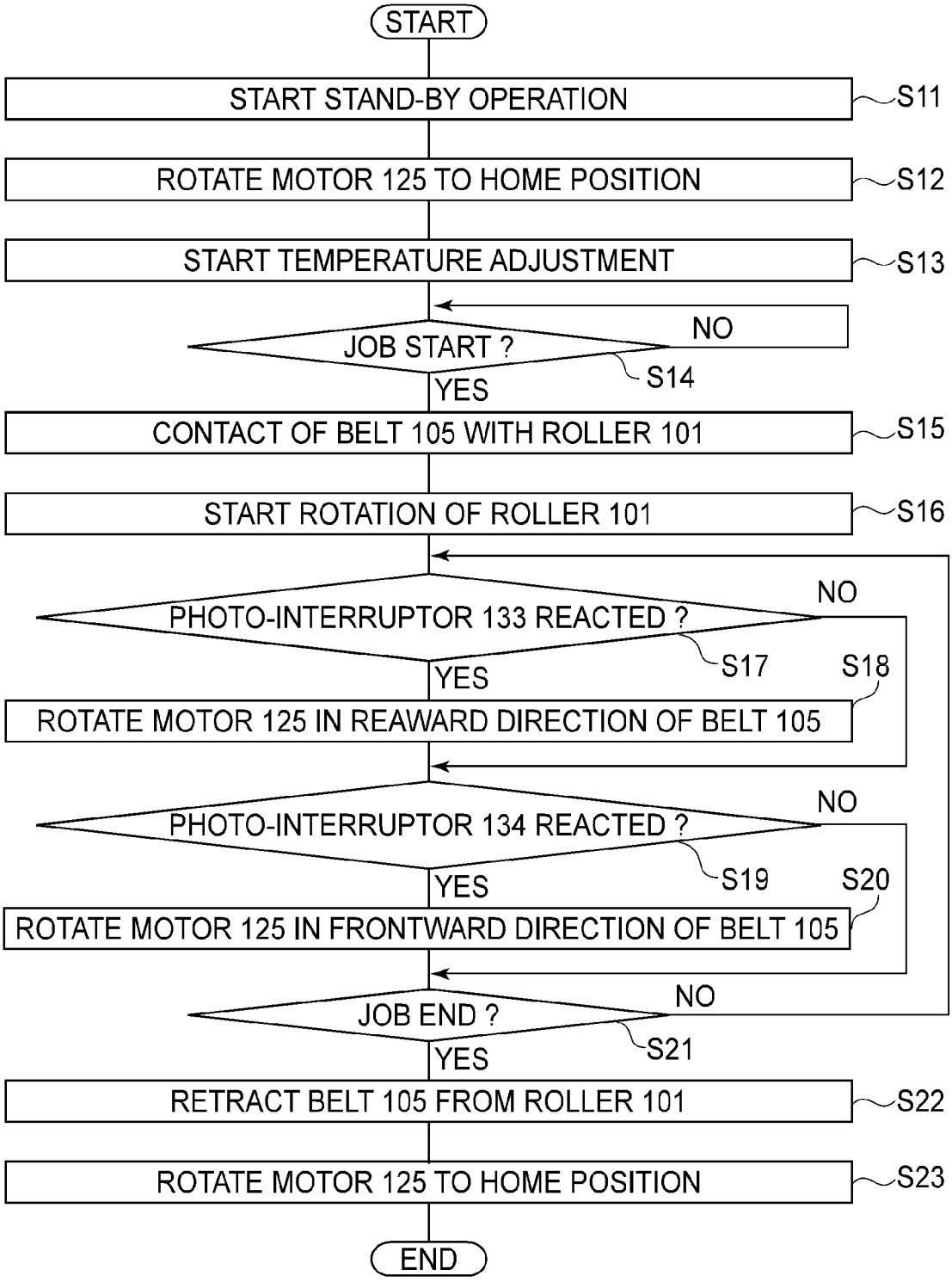

FIG. 14 is a flowchart of the steering control.

Figure 15:
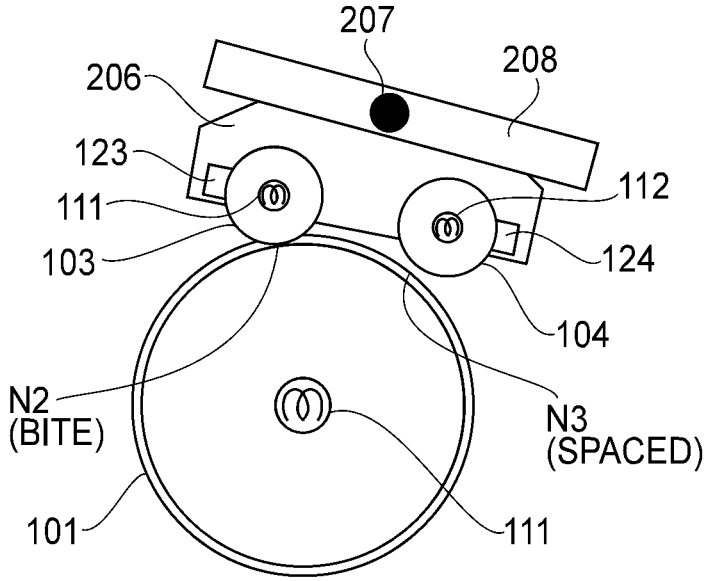
Figure 15:
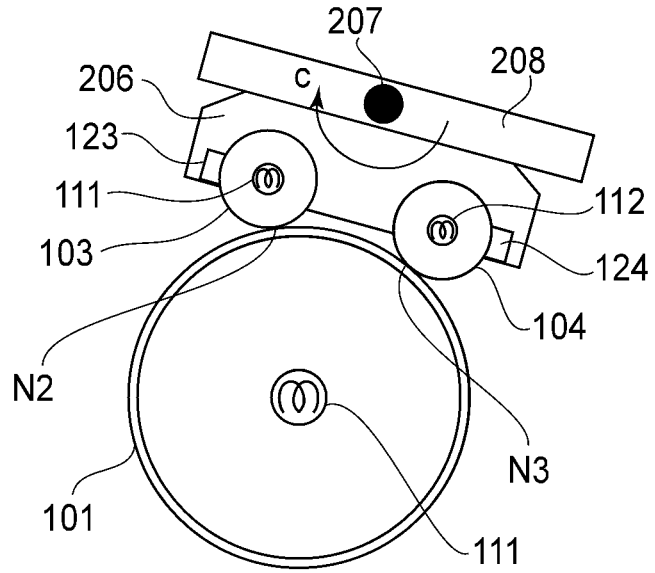

Parts (a) and (b) of FIG. 15 are illustrations of states of externally heating units at the steering angle θ in a comparison example and in First Embodiment, respectively.

Figure 16:
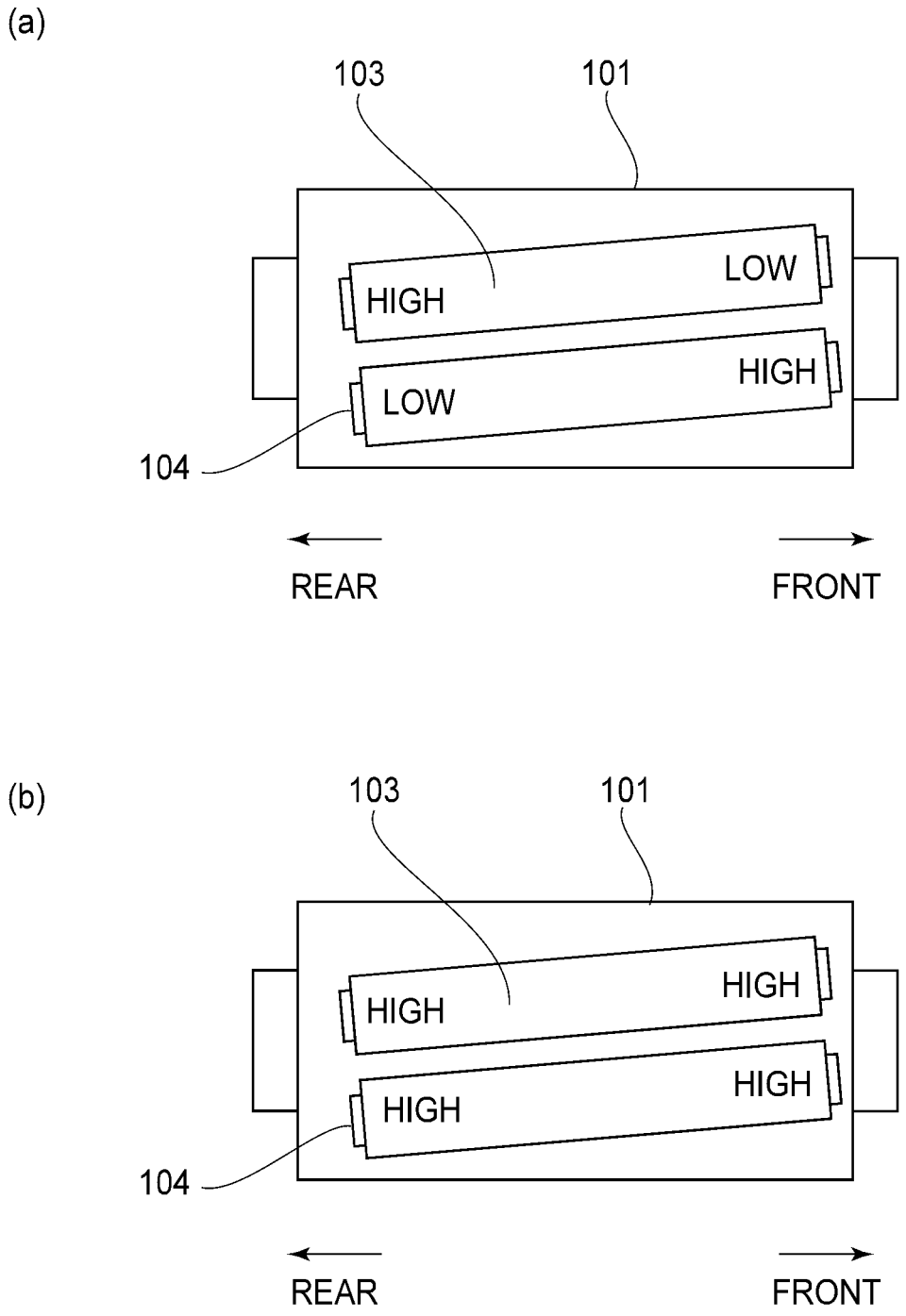

Parts (a) and (b) of FIG. 16 are schematic views for illustrating balances of urging forces (pressures) of externally heating rollers in the comparison example and in First Embodiment, respectively.

Figure 17:
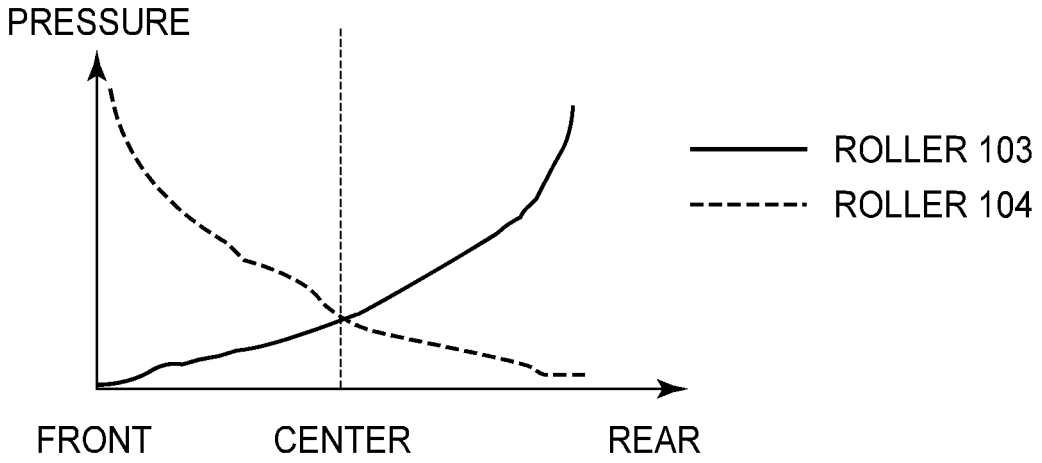
Figure 17:
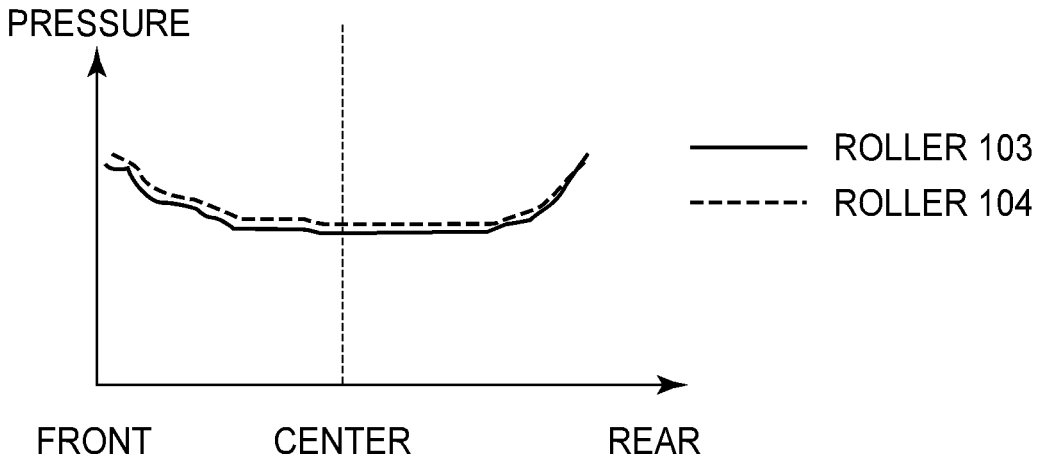

Parts (a) and (b) of FIG. 17 are graphs for illustrating measured urging force (pressure) distributions of the externally heating rollers in the comparison example and in First Embodiment, respectively.

Figure 18:
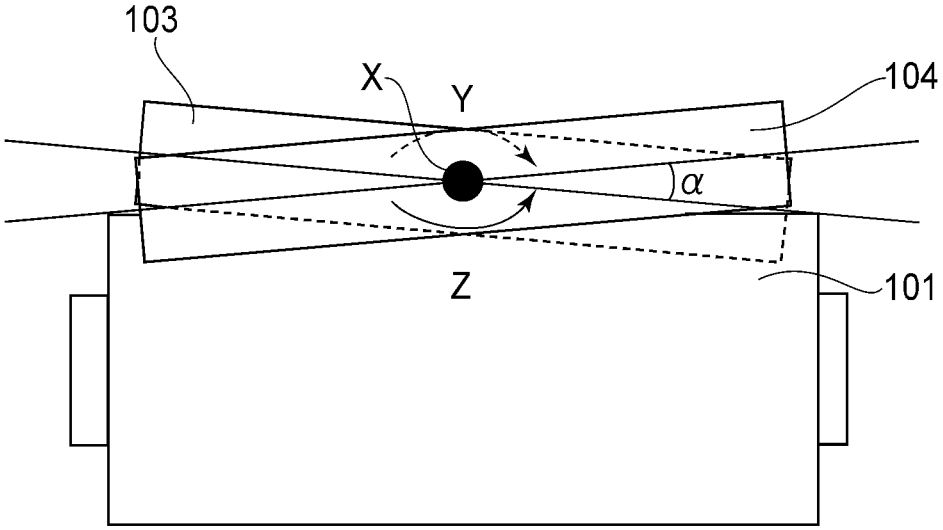

FIG. 18 is an illustration of a state of the externally heating rollers which are tilted in different directions.

Figure 19:
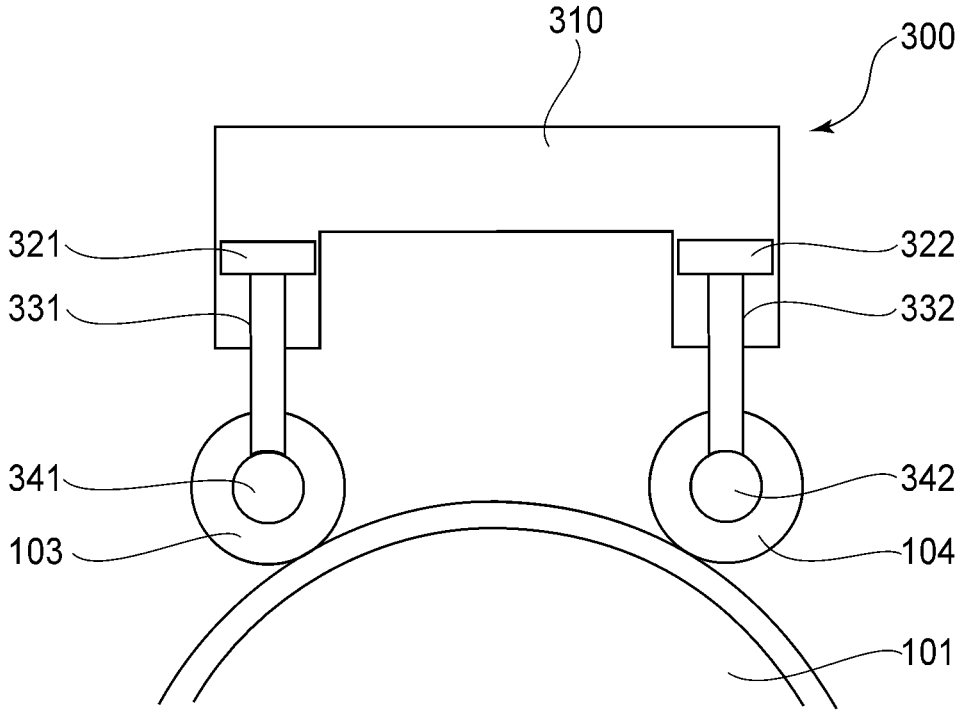

FIG. 19 is an illustration of a cylindrical type holding mechanism in Second Embodiment.

Figure 20:
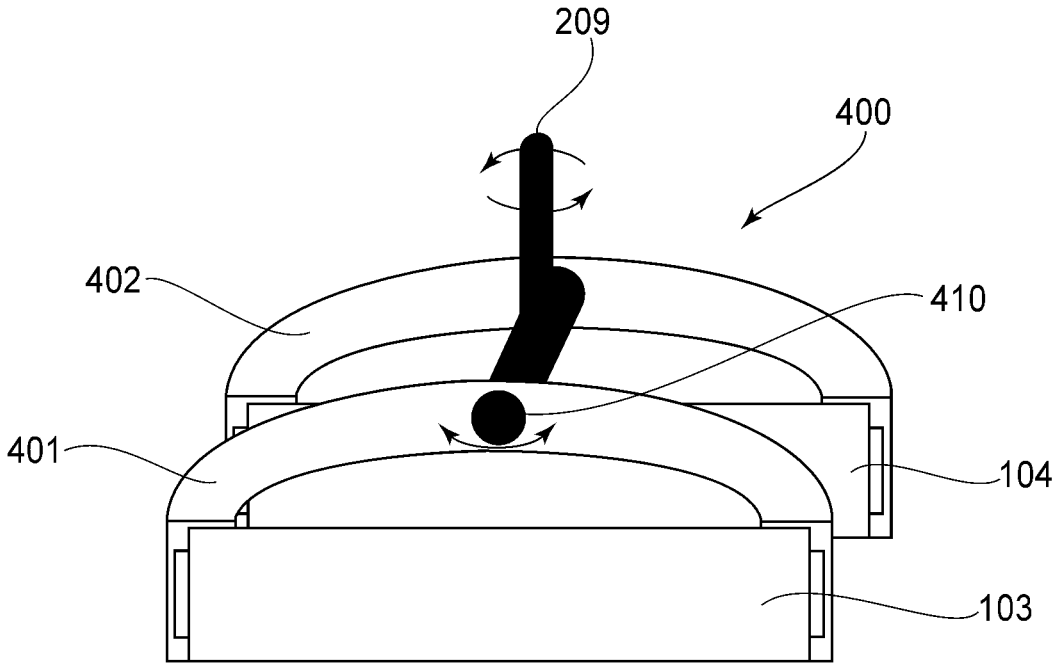

FIG. 20 is an illustration of a tilt holding frame in Third Embodiment.

Figure 21:
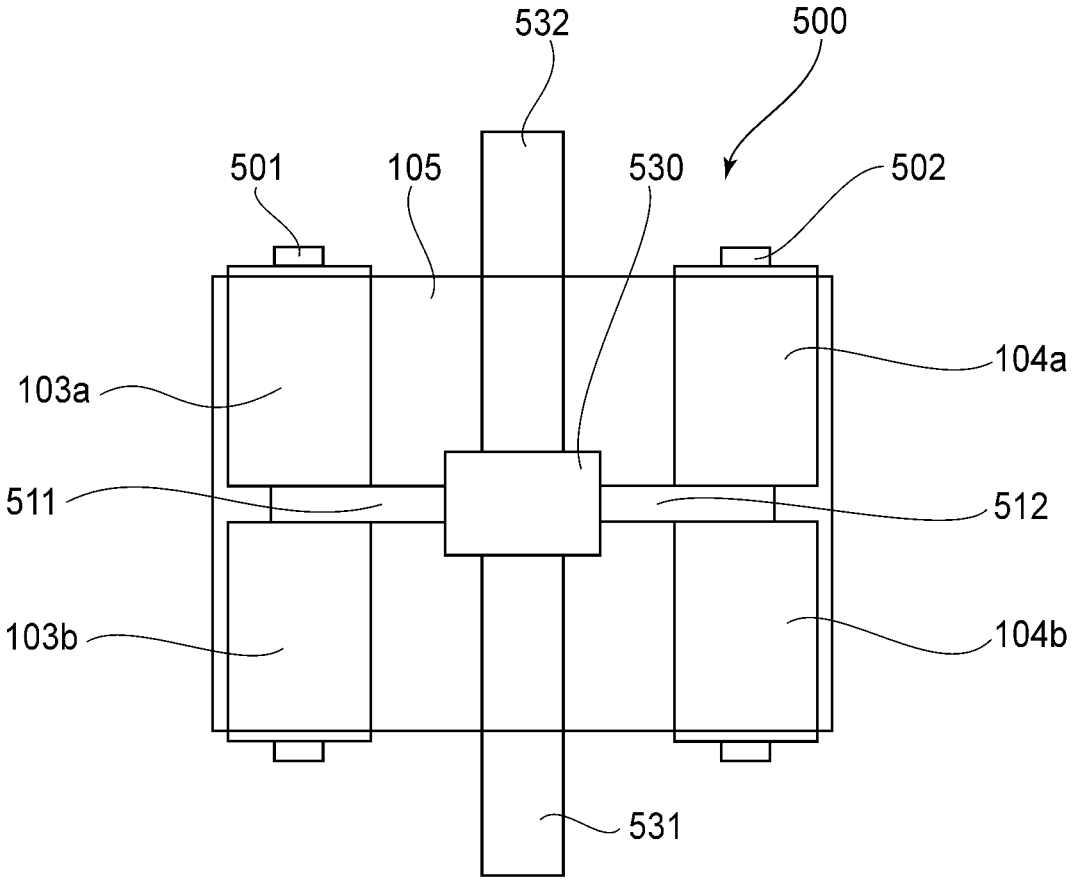

FIG. 21 is an illustration of a tilt skeleton mechanism in Fourth Embodiment.

Figure 22:
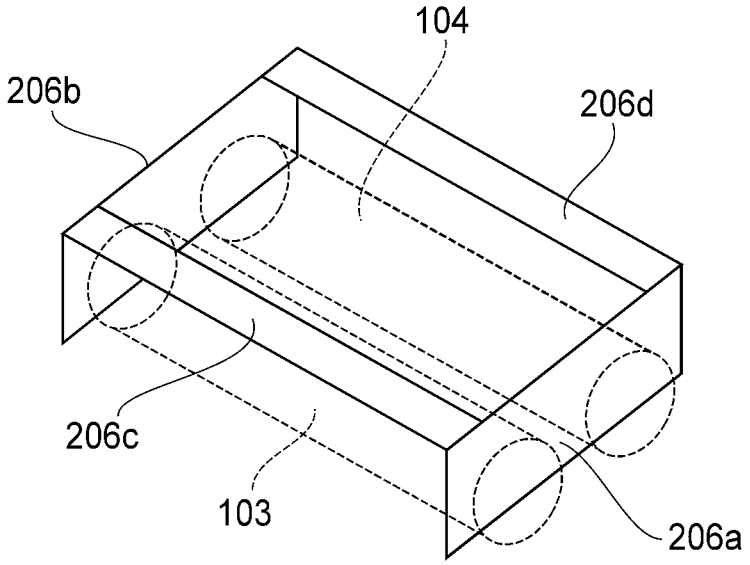
Figure 22:
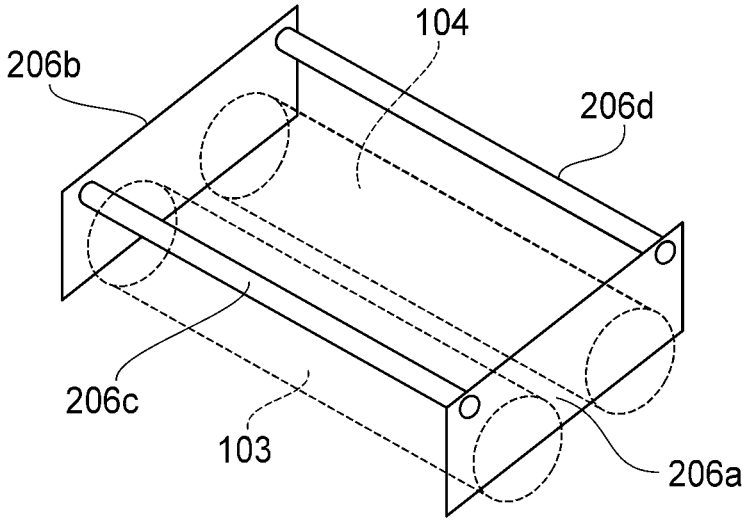

Parts (a) and (b) of FIG. 22 are illustrations of roller holding frames of an integral type and a connection type, respectively, in other embodiments.

Figure 23:
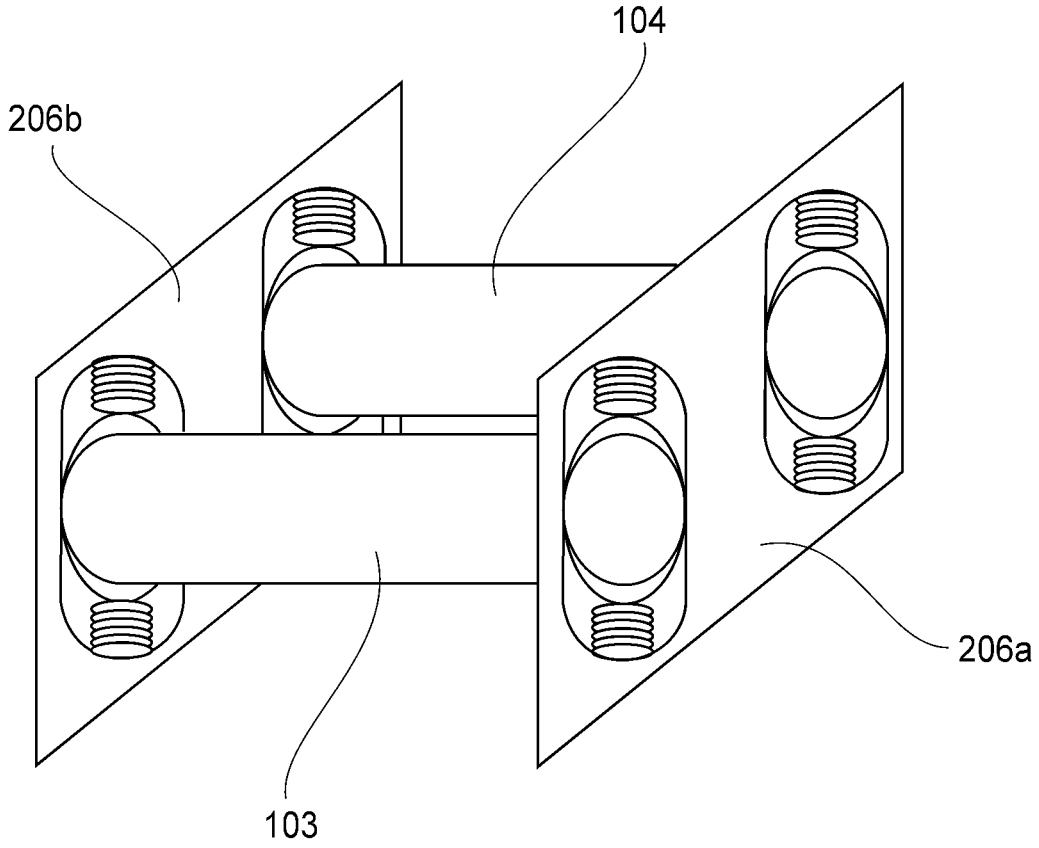

FIG. 23 is an illustration of a roller holding frame in another embodiment.

DESCRIPTION OF THE PREFERRED EMBODIMENTS

Embodiments of the present invention will be specifically described below with reference to the drawings. Incidentally, in the following embodiments, an image heating apparatus according to the present invention will be described by taking, as an example, a fixing device for fixing an unfixed toner image on a recording material. However, the image heating apparatus can also be carried out as a heat treatment device for adjusting a surface property of an image by heating and pressing the recording material on which a fixed image or a partly fixed image is carried.

First Embodiment

Figure 1:
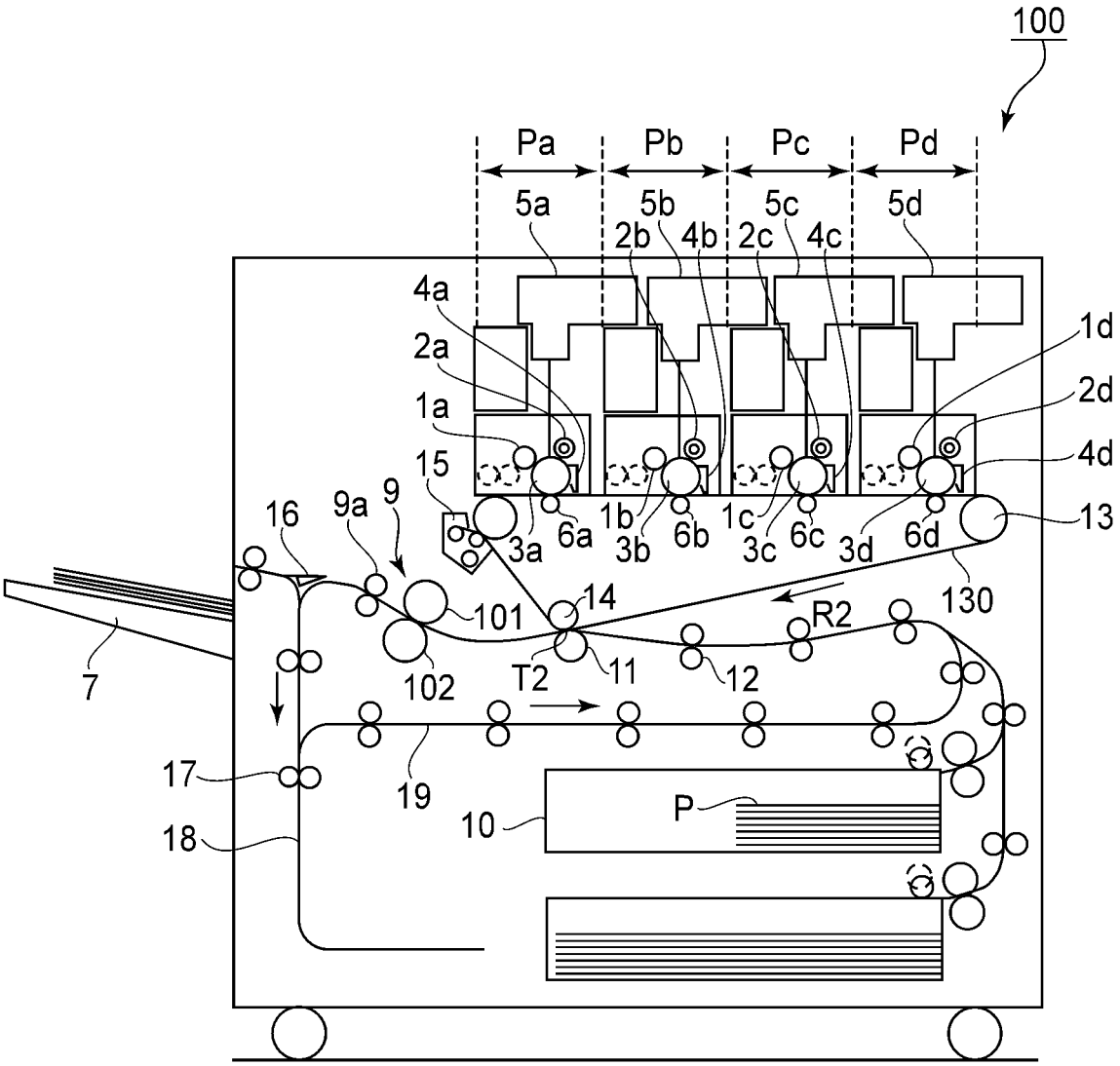
FIG. 1 is an illustration of a structure of an image forming apparatus.

First, an image forming apparatus 100 will be described with reference to FIG. 1. Incidentally, FIG. 1 is a schematic illustration showing the image forming apparatus 100 in which the fixing device functioning as the image heating apparatus is mounted. This image forming apparatus 100 is a tandem-type full-color laser printer of an intermediary transfer type in which first to fourth image forming portions Pa, Pb, Pc and Pd are arranged along a movement direction of an intermediary transfer belt 130. Incidentally, in FIG. 1, an externally heating unit described later is omitted from illustration.

[Image Forming Apparatus]

As shown in FIG. 1, in the image forming apparatus 100, the image forming portions Pa, Pb, Pc and Pd are juxtaposed, and in which toner images of different colors are formed, respectively, through a process of latent image formation, development and transfer.

In the image forming portion Pa, a yellow toner image is formed on a photosensitive drum 3*a* as an electrophotographic photosensitive member, and then is primary-transferred onto the intermediary transfer belt 130 in contact with the photosensitive drum 3*a*. Also in the image forming portions Pb, Pc and Pd, similarly, a magenta toner image, a cyan toner image and a black toner image are formed on photosensitive drums 3*b*, 3*c* and 3*d*, respectively, and then are primary-transferred successively onto the intermediary transfer belt 130.

A recording material (sheet) P is taken out from a recording material cassette 10 one by one by and is in stand-by between registration rollers 12. The recording material P is sent by the registration rollers 12 to a secondary transfer portion T2 while being timed to the toner images conveyed to the secondary transfer portion T2 by the intermediary transfer belt 130. The four color toner images are secondary-transferred from the intermediary transfer belt 130 onto the recording material P at the secondary transfer portion T2. The recording material P on which the four color toner images are secondary-transferred is conveyed into a fixing device (apparatus) 9 and is heated and pressed by the fixing device 9 to fix the toner images thereon. The recording material P on which the toner images have already been fixed is discharged onto a tray 7 outside the image forming apparatus.

Further, in the case of double-side printing, the recording material P on which first surface the toner images are secondary-transferred and then are fixed by the fixing device 9 is guided into a reversing path 18 by a flapper 16. The recording material P in the reversing path 18 is reversed by a reversing roller 17 to be guided to a path 19 for double-side printing. Then, the recording material P is again in stand-by between the registration rollers 12 and is sent to the secondary transfer portion T2, where the toner images are transferred onto a second surface of the recording material P. Then, the recording material P on which the images are fixed on first and second surfaces thereof by fixing the toner image, transferred on the second surface of the recording material P, by the fixing device 9 is discharged to the outside of the image forming apparatus.

The image forming portions Pa, Pb, Pc and Pd have the substantially same constitution except that the colors of toners of yellow, magenta, cyan and black used in developing devices 1*a*, 1*b*, 1*c* and 1*d* are different from each other. In the following description, the image forming portion Pa will be described and other image forming portions Pb, Pc and Pd will be omitted from redundant description.

The image forming portion Pa includes the photosensitive drum 3*a* around which a charging roller 2*a*, an exposure device 5*a*, the developing device 1*a*, a primary transfer roller 6*a*, and a drum cleaning device 4*a* are provided. The photosensitive drum 3*a* is prepared by forming a photosensitive layer on the surface of an aluminum cylinder. The charging roller 2*a* electrically charges the surface of the photosensitive drum 3*a* to a uniform potential. The exposure device 5*a* writes (forms) an electrostatic image for an image on the photosensitive drum 3*a* by scanning with a laser beam. The developing device 1*a* develops the electrostatic image to form the toner image on the photosensitive drum 3*a*. The primary transfer roller 6*a* is supplied with a voltage, so that the toner image on the photosensitive drum 3*a* is primary-transferred onto the intermediary transfer belt 130.

The drum cleaning device 4*a* rubs the photosensitive drum 3*a* with a cleaning blade to collect a transfer residual toner deposited on the photosensitive drum 3*a* without being transferred onto the intermediary transfer belt 130. A belt cleaning device 15 collects a transfer residual toner deposited on the intermediary transfer belt 130 without being transferred onto the recording material P at the secondary transfer portion T2.

[Fixing Device]

Figure 2:
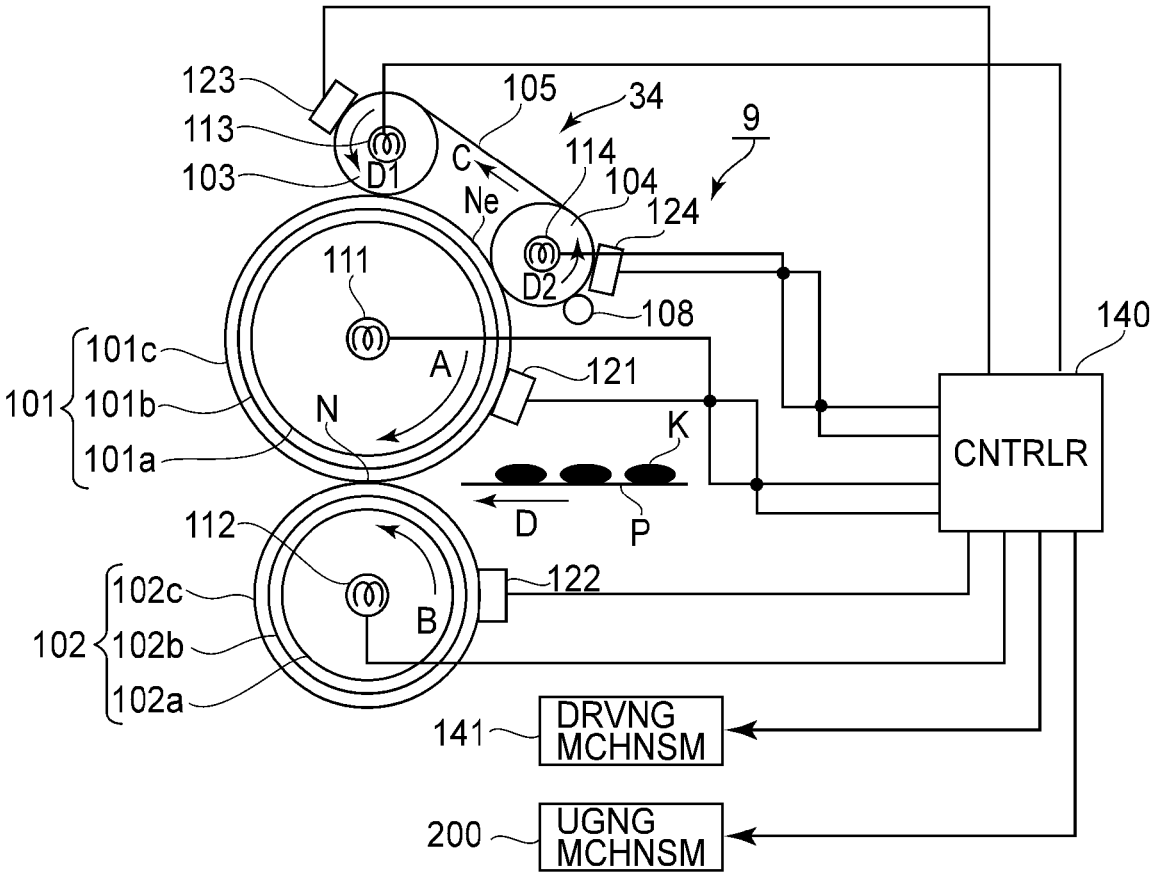
FIG. 2 is an illustration of a structure of a fixing device (apparatus) in First Embodiment.

Next, a structure of the fixing device 9 will be described with reference to FIG. 2. FIG. 2 is an illustration of the structure of the fixing device 9 including the externally heating unit in this embodiment. Incidentally, as described above, the image forming apparatus 100 includes the fixing device 9, and the image heating apparatus according to the present invention is applied as the fixing device 9.

The fixing device 9 functioning as the image heating apparatus includes a fixing roller 101 functioning as a rotatable heating member, a belt unit 34, a detector, a rotating (rotationally moving) mechanism and a displacing mechanism.

In the following, the fixing device 9 will be described specifically with reference to FIG. 2. Incidentally, a basic structure of the fixing device 9 will be described here, and the belt unit 34, the detector, the rotating mechanism and the displacing mechanism will be described later.

As shown in FIG. 2, the fixing device 9 forms a nip N for the recording material P by causing a pressing roller 102 to press-contact the fixing roller 101. At the nip N, the fixing device 9 performs a function of not only nip-conveying the recording material P on which an unfixed toner K is carried but also fixing the image on the recording material P by melting the unfixed toner on the recording material P.

The fixing roller 101 includes a core metal 101*a* and an elastic layer 101*b* formed on an outer peripheral surface of the core metal 101*a*. Further, a surface of the elastic layer 101*b* is coated with a parting layer 101*c*. The fixing roller 101 is rotationally driven by a driving mechanism 141 including a gear train, thus being rotated in an arrow A direction at a predetermined process speed.

The pressing roller 102 includes a core metal 102*a* and an elastic layer 102*b* formed on an outer peripheral surface of the core metal 102*a*. Further, a surface of the elastic layer 102*b* is coated with a parting layer 102*c*. The pressing roller 102 is rotationally driven by the driving mechanism 141, thus being rotated in an arrow B direction at a predetermined process speed. The pressing roller 102 is driven by a pressing mechanism 200 using an eccentric cam and is movable toward and away from the fixing roller 101. The pressing mechanism 200 presses the pressing roller 102 at predetermined pressure to co-operate the fixing roller 101 and the pressing roller 102, so that the nip N is formed between these two rollers.

A halogen heater 111 is provided non-rotatably inside the core metal 101*a* of the fixing roller 101. A thermistor 121 is provided in contact with the fixing roller 101 to detect a surface temperature of the fixing roller 101. A controller 140 effects ON/OFF control of the halogen heater 111 depending on a detected temperature by the thermistor 121, thus maintaining the surface temperature of the fixing roller 101 at a predetermined target temperature depending on the type of the recording material P.

A halogen heater 112 is provided non-rotatably inside the core metal 102*a* of the pressing roller 102. A thermistor 122 is provided in contact with the pressing roller 102 to detect a surface temperature of the pressing roller 102. The controller 140 effects ON/OFF control of the halogen heater 112 depending on a detected temperature by the thermistor 122, thus maintaining the surface temperature of the pressing roller 102 at the predetermined target temperature.

[Externally Heating Unit]

In the image forming apparatus, high productivity (the print number per unit time) has been required with respect to various recording materials such as thick paper. In order to enhance the productivity with respect to a recording material having a large basis weight, it is preferable that a heat treatment speed of the fixing device is increased (speed-up). However, from the recording material having the large basis weight, heat is taken in a large amount, and therefore it is a current status that a heat quantity required for fixing is remarkably large compared with the case where the toner (image) is fixed on a thin recording material, and therefore when the toner is fixed on the recording material having the large basis weight, the fixing (treatment) is effected by lowering the fixing speed.

Therefore, in the fixing device 9, the belt unit 34 is disposed so that the belt unit 34 is contactable to and retractable from the fixing roller 101. Further, by causing the belt unit 34 to press-contact the fixing roller 101, the fixing roller 101 is externally heated. By employing such a constitution, in this embodiment, even when the toner is fixed on the recording material having the large basis weight, it is possible to effect the fixing without lowering the fixing speed.

As shown in FIG. 2, at the outer peripheral surface of the fixing roller 101, a heat conduction property of the elastic layer 101*b* is low, and therefore there is the case where the thermal response from the halogen heater 111 is not in time with respect to the heat quantity taken by the recording material during the fixing. Therefore, as shown in FIG. 2, the belt unit 34 as an example of the externally heating unit of a type in which the belt is externally heated is employed. In the type in which the belt is externally heated, a contact area between the fixing roller 101 and the belt unit 34 which concern the heat conduction is wide, and therefore this type is characterized in that a large heat conduction amount can be obtained.

The belt unit 34 includes externally heating rollers 103 and 104 and an externally heating belt 105. The belt unit 34 ensures a necessary surface temperature of the fixing roller by extending the externally heating belt 105 around the externally heating rollers 103 and 104 each functioning as a supporting member (supporting roller) for supporting the externally heating belt 105 and then by bringing the externally heating belt 105 into contact with the fixing roller 101.

As shown in FIG. 2, the externally heating belt 105 externally heats the surface of the fixing roller 101 by being contacted to the outer peripheral surface of the fixing roller 101 to form a contact nip Ne. The externally heating belt 105 is stretched around the externally heating rollers 103 and 104. The externally heating belt 105 is frictionally driven with rotation of the fixing roller 101, thus being rotated in an arrow C direction by the rotation of the fixing roller 101.

The externally heating belt 105 is contacted to the rotatable heating member to function as an endless belt for heating the rotatable heating member. The externally heating belt 105 includes a base layer of metal such as stainless steel or nickel or of a resin material such as polyimide. A surface of the base layer is coated with a heat-resistant slidable layer using a fluorine-containing resin material in order to prevent deposition of the toner.

The externally heating rollers 103 and 104 are disposed side by side along a rotational direction of the fixing roller 101. The externally heating rollers 103 and 104 perform a function of not only stretching the externally heating belt 105 but also rotating in a state in which the externally heating belt 105 is pressed against the fixing roller 101. Further, the externally heating belt 105 is constituted so that the externally heating belt 105 is rotated by the rotation of the fixing roller 101, and the externally heating rollers 103 and 104 are constituted so that these rollers are rotate by the rotation of the externally heating belt 105.

Each of the externally heating rollers 103 and 104 is constituted by coating a rubber, a resin material or the like having a high parting property on a surface of a core metal thereof formed of metal, such as aluminum, iron or stainless steel, having high thermal conductivity. Further, the externally heating rollers 103 and 104 have hollow shapes in which halogen heaters 113 and 114, respectively, functioning as a heat source and disposed (incorporate) in a non-rotational state. Each of the halogen heaters 113 and 114 includes a plurality of heat sources (heaters) which are arranged along a rotational axis direction (longitudinal direction) of the externally heating roller 103 (or 104) and which are capable of being turned on and off.

A cleaning roller 108 is rotated by the rotation of the externally heating belt 105 by being urged against the externally heating belt 105 by an unshown urging mechanism at predetermined pressure, thus cleaning the surface of the externally heating belt 105.

Figure 3:
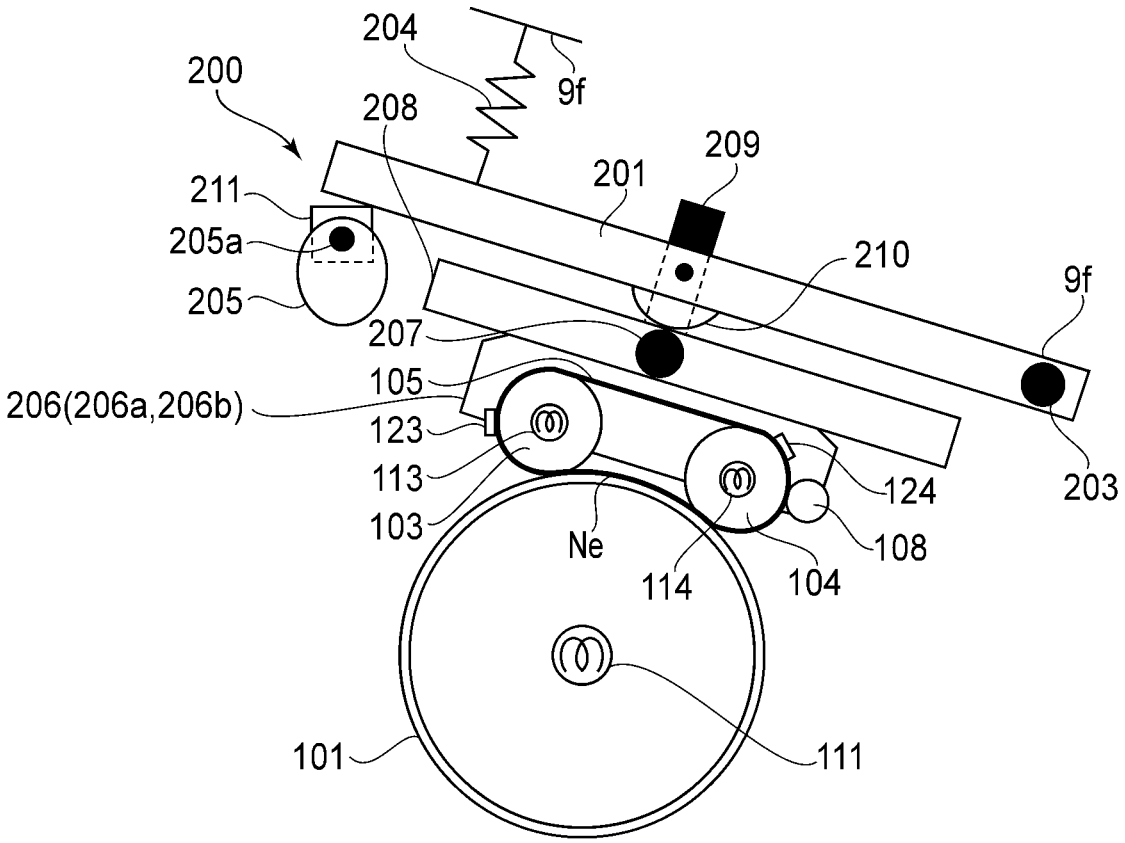
FIG. 3 is an illustration of a structure of an externally heating unit.

A thermistor 123 is provided in contact with the externally heating belt 105 in a position of the externally heating roller 103 to detect the surface temperature of the fixing roller 101. FIG. 3 is an illustration of a structure of the externally heating unit. The controller 140 effects, as shown in FIG. 3, ON/OFF control of the plurality of heat sources of the halogen heater 113 depending on a detected temperature of the thermistor 123 (123*a*, 123*b*), thus maintaining the surface temperature of the externally heating roller 103 at a predetermined target temperature depending on a longitudinal position of the externally heating roller 103.

A thermistor 124 is provided in contact with the externally heating belt 105 in a position of the externally heating roller 104 to detect the surface temperature of the fixing roller 101. The controller 140 effects, ON/OFF control of the plurality of heat sources of the halogen heater 114 depending on a detected temperature of the thermistor 124 (124*a*, 124*b*), thus maintaining the surface temperature of the externally heating roller 104 at a predetermined target temperature depending on a longitudinal position of the externally heating roller 104.

The target temperature of the externally heating rollers 103 and 104 is set so as to be higher than the target temperature of the fixing roller 101. This is because in the case where the surface temperature of the externally heating belt 105 is kept at a higher value than the surface temperature of the fixing roller 101, heat can be efficiently supplied from the externally heating belt 105 when the surface temperature of the fixing roller 101 is lowered.

FIG. 5 is an illustration of a steering angle θ with steering control.

Incidentally, in this embodiment, the externally heating belt 105 is used in the belt unit 34, but it has been known that lateral shift (deviation) movement of the belt is generated in the mechanism using the belt in general. That is, in this embodiment, there is a fear that the externally heating belt 105 is laterally shifted and moved, along the externally heating rollers 103 and 104 during a rotating operation, due to deviation of parallelism or the like.

Here, in order to regulate (limit) the lateral shift or deviation (lateral movement) of the externally heating belt 105, it would be considered that a belt regulating (limiting) plate (flange) is provided at each of end portions of each of the externally heating rollers 103 and 104, and then a belt edge is abutted against the belt regulating plate. However, when a shift force of the belt edge exerted on the belt regulating plate is large, there is a possibility that the belt edge is abraded or deformed with sliding with the belt regulating plate, and thus a lifetime of the belt is lowered (shortened).

Therefore, in this embodiment, a method in which the lateral shift (movement) of the belt is intentionally generated and is then controlled is employed. Specifically, as shown in FIG. 5, the belt unit 34 is contacted to the fixing roller 101 so that a representative widthwise line of the belt unit 34 provide a crossing angle with respect to a rotational axis direction of the fixing roller 101.

More specifically, as shown in FIG. 5, a widthwise axis (axial line) of the belt unit 34 parallel to two axes of the externally heating rollers 103 and 104 when the two axes of the externally heating rollers 103 and 104 are parallel to each other as seen from above the belt unit 34 is taken as the representative widthwise line of the belt unit 34. Further, an angle where the representative widthwise line of the belt unit 34 and a rotational axis of the fixing roller 101 cross each other is referred to as the steering angle θ.

Further, the belt unit 34 is inclined so as to generate the steering angle θ, thus being contacted to the fixing roller 101. Then, at the contact portion Ne, a surface movement direction of the fixing roller 101 and a surface movement direction of the externally heating belt 105 are made different from each other, so that a frictional force is generated between the fixing roller 101 and the externally heating belt 105. As a result, the externally heating belt 105 is laterally shifted (moved) by this frictional force. For that reason, by controlling the steering angle θ, it becomes possible to effect control of the lateral shift of the belt. Incidentally, at the contact portion Ne, an angle formed between the surface movement direction of the fixing roller 101 and the surface movement direction of the externally heating belt 105 and the steering angle θ can be regarded as substantially the same.

The above-described change in steering angle θ is made by the rotating mechanism described later and is controlled so that a range of the lateral shift of the externally heating belt 105 falls within a predetermined travelling range (zone).

[Steering Mechanism]

Parts (a) and (b) of FIG. 4 are a perspective view and a mechanism view, respectively, of the externally heating unit. FIG. 6 is an illustration of a structure of the externally heating unit supported by the steering mechanism. FIG. 7 is an illustration of the steering mechanism. FIG. 8 is an illustration of a driving portion of the steering mechanism. FIG. 9 is a graph showing a relationship between a movement amount of a supporting shaft and a shift(ing) force of the externally heating belt. In the following, the steering mechanism for supporting the belt unit 34 so that the steering angle θ is changeable will be specifically described.

Incidentally, in the following description, a front side refers to a side of an arrow L direction in FIG. 7, and a rear side refers to a side of an arrow M direction in FIG. 7.

In a belt shift control method in this embodiment, as shown in FIG. 5, the belt unit 34 is rotationally moved (rotated) about an axis parallel to a direction normal to the contact portion Ne where the fixing roller 101 and the externally heating belt 105 contact each other. Hereinafter, this rotational movement (rotation) is referred to as unit rotational movement (unit rotation). For that purpose, the externally heating unit shown in (a) of FIG. 4 is supported by a rotation shaft 209 is as to permit the unit rotation as shown in FIG. 6. Incidentally, when the belt unit 34 is supported so as to permit the unit rotation, the rotation shaft 209 along a center axis of the unit rotation is not necessarily required to be provided. For example, a constitution in which supporting shafts 207*a* and 207*d* moved with the unit rotation of the belt unit 34 are accurately supported may also be employed.

As shown in FIG. 13, the supporting shaft 203 of an urging frame 201 is fixed on a main assembly side plat 202 at ends thereof. A swingable frame and the belt unit 34 are integrally rotatable with the urging frame 201 about the rotation shaft 209 as a center axis. A supporting shaft 207*a* fixed on the swingable frame 208 is held with a clearance from the main assembly side plate 202, and is movable in arrow H and J directions, in a clearance range, with movement of an arm portion 118*a* of a warm wheel 118.

As shown in FIG. 8, a sector warm wheel 118 rotatable around the rotation shaft 119 is engaged with a warm gear 120. When a motor 125 is rotated in a normal direction to rotate the sector warm wheel 118 in an arrow G, the arm portion 118*a* is moved in the arrow H direction to move the supporting shaft 207*a* in the arrow H direction. When the motor 125 is rotated in a reverse direction to rotate the sector warm wheel 118 in an arrow I direction, the arm portion 118*a* is moved in the arrow J direction to move the supporting shaft 207*a* in the arrow J direction.

As shown in FIG. 7, when the swingable frame 208 and the belt unit 34 are moved in the arrow H or J direction in the front side, the belt unit 34 causes the unit rotation around the rotation shaft 209. Then, as shown in FIG. 12, the steering angle θ is set between the fixing roller 101 and the belt unit 34. Incidentally, as a method of causing the unit rotation of the swingable frame 208 and the belt unit 34, a method of directly rotating the rotation shaft 209 by the motor or the like may also be employed.

Here, it is confirmed that there is a relationship the steering angle θ between the fixing roller 101 and the belt unit 34 and a shift (shifting) speed of the externally heating belt 105. Further, by externally adjusting the steering angle θ between the fixing roller 101 and the belt unit 34, a direction and speed of the lateral shift (movement) of the externally heating belt 105 along the externally heating rollers 103 and 104 can be controlled.

As shown in FIG. 9, in the case where the supporting shaft 207*a* is moved from a point where the shift force is zero to the H direction, the shift force for moving the externally heating belt 105 toward the rear side (arrow M direction) of the fixing roller 101 becomes large. In the case where the supporting shaft 207*a* is moved from the point where the shift force is zero to the J direction, the shift force for moving the externally heating belt 105 toward the front side (arrow L direction) of the fixing roller 101 becomes large. In this way, by moving the supporting shaft 207*a* in the arrow H and J directions, a direction in which the externally heating belt 105 is shifted can be controlled.

FIG. 9 shows a result of measurement of the shift force of the externally heating belt 105 by changing a mounting position of the supporting shaft 207*a*. A measuring method of the shift force of the externally heating belt 105 is performed in the following procedure. Rotatable rollers are contacted to ends of the externally heating belt 105, and when the externally heating belt 105 is rotated by the rotation of the fixing roller 101, a load exerted on the rotatable roller by the shift of the externally heating belt 105 in the longitudinal direction (belt widthwise direction) was outputted by a load cell.

In FIG. 9, the abscissa represents the mounting position of the supporting shaft 207*a*, and a point of zero is an ideal mounting position where the externally heating belt 105 remains without being shifted. In FIG. 9, the arrow H direction (FIG. 7) is a positive direction, and the arrow J direction is a negative direction. Further, the ordinate in FIG. 9 represents the shift force of the externally heating belt 105, and a force for moving the externally heating belt 105 in the arrow L direction is a positive force and a force for moving the externally heating belt 105 in the arrow M direction is a negative force.

[Belt Shift Amount Detecting Sensor]

FIG. 10 is an illustration of an arrangement of a belt shift amount detecting sensor functioning as a detector for detecting deviation of the belt from a predetermined travelling range (zone). Parts (a) and (b) of FIG. 11 are illustrations of rotational directions of sensor flags in the cases where the belt is shifted in a longitudinal front side and is a longitudinal rear side, respectively. In the following, a constitution of the detector for detecting the lateral shift of the externally heating belt 105 will be specifically described.

As shown in FIG. 10, an arm 129 and a roller 128 are integrally rotated around a rotation shaft 126. A sensor flag 132 is rotated around the rotation shaft 136. The arm 129 and the sensor flag 132 are engaged by a link portion 138 to transmit a rotational force.

The roller 128 contacts the belt edge of the externally heating belt 105. A tilt spring 131 applies a torque to the arm 129 to urge the roller 128 in an arrow Q direction. For that reason, when the externally heating belt is shifted in the arrow Q direction, the link portion 138 is moved in an arrow P direction. When the externally heating belt 105 is shifted in an arrow R direction, the link portion 138 is moved in an arrow O direction.

Along the sensor flag 132, photo-interruptors 133 and 134 are provided. The photo-interruptors 133 and 134 detect four edges of two slits formed in the sensor flag 132 and invert outputs of the detection. Correspondingly to the four edges of the sensor flag 132, shift positions of the externally heating belt 105 are defined. As an example, the photo-interruptors 133 and 134 are disposed so that the externally heating belt 105 repeats the lateral shift within an amplitude range of 5 mm as a traveling range (zone).

As shown in (a) of FIG. 11, in the case where the externally heating belt 105 is shifted in the arrow R direction, the arm 129 is rotated in an arrow S direction, so that the sensor flag 132 is rotated in an arrow T direction to turn off the photo-interruptor 133 and to turn on the photo-interruptor 134.

As shown in (b) of FIG. 11, in the case where the externally heating belt 105 is shifted in the arrow Q direction, the arm 129 is rotated in an arrow U direction, so that the sensor flag 132 is rotated in an arrow V direction to turn on the photo-interruptor 133 and to turn off the photo-interruptor 134.

As described above, the roller 128, the tilt spring 131, the arm 129, the link portion 138, the sensor flag 132, and the photo-interruptors 133 and 134 function as the detector for detecting the deviation of the belt from the predetermined traveling range (zone).

[Steering Control]

FIG. 12 is a block diagram of a control system of the fixing device. FIG. 3 is an illustration of an arrangement of a home position sensor. FIG. 14 is a flowchart of steering control of the belt unit 34. In the following, flow of control of the belt unit 34 rotatably supported by the steering mechanism will be specifically described.

As shown in FIG. 12, the controller 140 controls the motor 125 via a motor controller 51 and a motor driver 52 to effect shift control of the externally heating belt 105. The controller 140 detects the shift position of the externally heating belt 105 on the basis of outputs of the photo-interruptors 133 and 134.

In addition to the warm wheel 118, the warm gear 120, the motor 125 and the arm portion 118 which are described as the steering mechanism, portions including the controller 140, the motor controller 51 and the motor driver 52 function as the rotating mechanism. The rotating mechanism causes the unit rotation of the belt unit 34 depending on an output from the detector.

The controller 140 actuates, when the externally heating belt 105 is shifted to a predetermined position in the front side, the motor 125 to move the supporting shaft 207*a* in the arrow H direction (FIG. 7), thus causing the shift force toward the rear side to act on the externally heating belt 105. The controller actuates, when the externally heating belt 105 is shifted to a predetermined position in the rear side, the motor 125 to move the supporting shaft 207*a* in the arrow J direction (FIG. 7), thus causing the shift force toward the front side to act on the externally heating belt 105.

As shown in FIG. 13, a photo-interruptor 135 detects a home position of the sector warm wheel 118. The photo-interruptor 135 detects the home position when the motor 125 is actuated to make the externally heating rollers 103 and 104 parallel to the fixing roller 101.

As shown in FIG. 7, when the externally heating belt 105 is rotated by the rotation of the fixing roller 101 to be shifted in the front side or the rear side, the supporting shaft 207*a* is moved so that the shift force acts on the externally heating belt 105 in a direction opposite to the shift direction of the externally heating belt 105. A movement amount of the supporting shaft 207*a* is 2 mm from the home position with respect to each of the arrow H and J directions.

As shown in FIG. 14 with reference to FIG. 12, the controller 140 rotates, when a stand-by operation is started (S11), the motor 125 to provide the externally heating belt 105 with the steering angle θ of zero degrees, thus detecting the home position by the photo-interruptor 135 (S12). Here, the steering angle θ is, as shown in FIG. 5, an angle of the belt unit 34 with respect to the fixing roller 101. Accordingly, the steering angle θ when the axes of the externally heating rollers 103 and 104 and the axis of the fixing roller 101 are parallel to each other is taken as zero degrees. Incidentally, the steering angle θ used in the belt shift control in the direction is ±1.25 degrees, and is an angle where an end portion of the belt unit 34 is not extremely separated (spaced) from the fixing roller 101.

The controller 140 supplies electric energy (power) to the halogen heaters 111, 112, 113 and 114 to start temperature adjustment of the fixing roller 101, the pressing roller 102 and the externally heating rollers 103 and 104 (S13). The controller 140 rotates, when an image forming job is started (YES of S14), a pressure releasing cam 205 to bring the externally heating belt 105 into contact with the fixing roller 101 (S15). The externally heating belt 105 is rotated by rotation of the fixing roller 101 (S16).

The controller 140 rotates, when the externally heating belt 105 is shifted in the front side to turn off the photo-interruptor 133 (YES of S17), the motor 125 to move the supporting shaft 207*a* in a direction in which the externally heating belt 105 is shifted in the rear side (S18). The controller 140 rotates, when the externally heating belt 105 is shifted in the rear side to turn off the photo-interruptor 134 (YES of S19), the motor 125 to move the supporting shaft 207*a* in a direction in which the externally heating belt 105 is shifted in the front side (S20).

The controller 140 continues, until the image forming job is ended (NO of S21), the shift control of the externally heating belt 105 (S17 to S21). The controller 140 rotates, when the image forming job is ended (YES of S21), the pressure releasing cam 205, thus retracting the externally heating belt 105 from the fixing roller 101 (S22).

The controller 140 rotates the motor 125 to cause the steering angle θ between the fixing roller 101 and the externally heating rollers 103 and 104 to approach zero degrees, thus causing the photo-interruptor 135 to detect the home position to stop the motor 125 (S23). Incidentally, in the steering control, the steering angle θ is not necessarily be made zero degrees, i.e., the home position, and further, a constitution in which there is no home position may also be employed. For example, a constitution in which the steering angle θ is changeable to a steering angle θ1 where the externally heating belt 105 is shifted toward the front side and a steering angle θ where the externally heating belt 105 is shifted toward the rear side.

[Supporting Mechanism]

Parts (a) and (b) of FIG. 15 are illustrations of states of externally heating units at the steering angle θ in a comparison example and in this embodiment (First Embodiment), respectively. Parts (a) and (b) of FIG. 16 are illustrations which concern balances of pressure of externally heating rollers in the comparison example and in this embodiment, respectively. Parts (a) and (b) of FIG. 17 are illustrations of measurement of pressure distributions of the externally heating rollers in the comparison example and in this embodiment, respectively. FIG. 18 is a state view of the externally heating rollers in which axes of these rollers are tilted in different direction. In the following, a constitution of a supporting mechanism for supporting the belt unit 34 to be urged toward the fixing roller 101 so that the externally heating belt 105 is contacted to the fixing roller 101 to form the contact portion Ne will be described specifically. Incidentally, in FIGS. 15, 16 and 18, the externally heating belt 105 is omitted from illustration.

The belt unit 34 causes the unit rotation by the rotating mechanism described later to have a crossing angle with respect to the fixing roller 101. At this time, when a relative position between the externally heating rollers 103 and 104 is fixed, each of the externally heating rollers 103 and 104 is urged at a longitudinal end portion thereof so that the externally heating belt 105 contacts the fixing roller 101. Therefore, the pressure distribution at the contact portion Ne causes variation. Further, a contact length of the contact portion Ne along the movement direction of the externally heating belt 105 varies depending on a widthwise position of the externally heating belt 105.

Thus, in the case where a proper pressure distribution with respect to the fixing roller 101 cannot be obtained, the surface of the fixing roller 101 is non-uniformly heated with respect to the longitudinal direction by each of the externally heating roller 103 (104) and the externally heating belt 105. As a result, there is a fear that in-plane non-uniformity of fixing property of a color image on the recording material (member) is generated or that image defect such as gloss fluctuation (uneven gloss) is generated.

For that reason, it is desirable that the externally heating rollers 103 and 104 are inclined in a direction in which localization of the pressure distribution is reduced. Further, localization of the contact pressure of the externally heating rollers 103 and 104 is in an alternate state between the front side and the rear side. Accordingly, as shown in FIG. 18, it is desirable that the externally heating rollers 103 and 104 are rotationally moved (rotated), along a tangential direction of the fixing roller 101, in an arrow Y direction (clockwise direction) and an arrow Z direction (counterclockwise direction), respectively. Hereinafter, this rotational movement (rotation) is referred to as tilt. Then, as an example of a method in which the tilt of the externally heating rollers 103 and 104 is caused, a supporting mechanism including a displacing mechanism for permitting the tilt of the externally heating rollers 103 and 104 will be described in detail. Further, as shown in FIG. 18, when the externally heating rollers 103 and 104 are viewed from a direction of an axis X, a crossing angle, formed between the axis of the externally heating roller 103 and the axis of the externally heating roller 104, generated by the tilt is referred to as a tilt angle α.

Further, the tilt angle α is changed depending on a change in steering angle θ which is the crossing angle between the fixing roller 101 and the externally heating unit 34. That is, an absolute value of the tilt angle becomes larger with a larger absolute value of the steering angle For example, when the belt unit 34 is contacted to the fixing roller 101 at the first steering angle θ1 and the second steering angle θ2 larger in absolute value than the first steering angle θ1, an absolute value of a second tilt angle α2 when the steering angle is the second steering angle θ2 is larger than an absolute value of a first tilt angle α1 when the steering angle is the first steering angle θ1.

Here, a center of the unit rotation of the belt unit 34 by the rotating mechanism is located at a substantially longitudinal central portion of the belt unit 34. The "substantially longitudinal central portion" is located within a range in which a widthwise position of the externally heating belt 105 is shifted (moved) and may preferably be a position which permits an error, from a center position of this range, due to part accuracy or assembling accuracy.

The axis X as the center of the tilt is determined by the position of the center of the unit rotation of the belt unit 34, and therefore by this constitution, the externally heating rollers 103 and 104 have the tilt angle α on the basis of the longitudinal center. Accordingly, it is possible to suppress a distance from the tilt center to a remote-side end portion of end portions of the externally heating rollers 103 and 104 with respect to the rotational axis direction. Therefore, extension of the externally heating belt 105 due to extension of a spacing between the end portions of the externally heating rollers 103 and 104 by the tilt can be suppressed, and therefore a load exerted on the externally heating belt 105 can be reduced. Further, the load can be dispersed to end portion sides so as not to be localized only in one end portion side.

As shown in FIG. 4, a roller holding frame 206*a* functions as a first holding member for holding an end portion in one end side (front side) of the externally heating rollers 103 and 104 with respect to the belt widthwise direction. A roller holding frame 206*b* functions as a second holding member for holding another end portion in another end side (rear side) of the externally heating rollers 103 and 104 with respect to the belt widthwise direction. As shown in FIG. 15, the roller holding frames 206 (206*a*, 206*b*) are rotationally movable (rotatable) in an arrow C direction and a direction opposite to the arrow C direction, respectively, about an axis of a supporting shaft 207. Hereinafter, this rotation movement (rotation) is referred as an end portion rotational movement (rotation).

Incidentally, when the roller holding frames 206 (206*a*, 206*b*) cause the end portion rotations in opposite directions, the externally heating roller 103 is raised in one end side and is lowered in another end side with respect to the rotational axis direction. Further, the externally heating roller 104 is raised in another end side and is lowered in one end side with respect to the rotational axis direction. For this reason, the externally heating rollers 103 and 104 cause the tilt. This phenomenon actually can occur by the contact of the belt unit 34 with the fixing roller 101.

By urging the belt unit 34 against the fixing roller 101, the fixing roller 101 is placed in a state in which the fixing roller 101 bites into between the externally heating rollers 103 and 104. In this state, when the steering angle θ is generated between the fixing roller 101 and the belt unit 34 by the rotating mechanism, the roller holding frames 206*a* and 206*b* cause the end portion rotation in opposite directions by receiving reaction from the pressing roller 101. As a result, the externally heating rollers 103 and 104 held by the roller holding frames 206*a* and 206*b* cause the tilt.

At this time, the biting constitution into between the externally heating rollers 103 and 104 is not limited to that of the fixing roller 101. For example, a fixing belt urged from an inner surface thereof toward the belt unit 34 by the roller having a position relationship with the externally heating belt 105 such that the rollers opposes the externally heating belt 105 may also be used. In the following, a constitution of the supporting mechanism will be specifically described.

As shown in (a) of FIG. 4, the roller holding frame 206*a* as an example of the first holding member rotatably holds (supports) the front side end portions of the externally heating rollers 103 and 104. The roller holding frame 206*b* as an example of the second holding member rotatably holds (supports) the rear side end portions of the externally heating rollers 103 and 104.

By this constitution, the roller holding frames 206 (206*a*, 206*b*) have the following features.

The roller holding frame 206*a* is swingable, with the unit rotation of the belt unit 34 by the rotating mechanism, in a direction in which forces of the externally heating rollers 103 and 104, respectively, urging the externally heating belt 105 toward the fixing roller 101 in one widthwise end side are equal to each other, that is, in a direction of equalizing them.

The roller holding frame 206*b* is swingable, with the unit rotation of the belt unit 34 by the rotating mechanism, in a direction in which forces of the externally heating rollers 103 and 104, respectively, for urging the externally heating belt 105 toward the fixing roller 101 in another widthwise end side are equal to each other, that is, in a direction of equalizing them.

Further, in this embodiment, when the steering angle between the fixing roller 101 and the belt unit 34 is zero degrees, i.e., when the fixing roller 101 and the externally heating rollers 103 and 104 are substantially parallel to each other, the following constitution is employed.

The constitution is such that on a perpendicular bisector connecting the rotation centers of the externally heating rollers 103 and 104, the rotation center of the fixing roller 101 and the end portion rotation centers of the roller holding frames 206*a* and 206*b* are disposed.

By this constitution, when diameters of the externally heating rollers 103 and 104 are equal to each other, an effect such that pressures applied to the externally heating rollers 103 and 104 are equally distributed can be obtained. This is because when the reactions from the fixing roller 101 to the externally heating rollers 103 and 104 are equal to each other, a phantom arm length is provided so that values of moment of the roller holding frames 206 are balanced with each other.

However, at this time, the pressures applied to the externally heating rollers 103 and 104 are not necessarily be equally distributed. Accordingly, the end portion rotation centers of the roller holding frames 206*a* and 206*b* are not necessarily required to be disposed in the above-described positions. Therefore, the end portion rotation centers may only be required that the roller holding frames 206 are capable of achieving the moment balance. For example, the end portion rotation centers may be disposed in an arbitrary position between the axes of the externally heating rollers 103 and 104.

The roller holding frame 206*a* is an L-shaped member extended from a portion where the end portions of the externally heating rollers 103 and 104 are supported in one side, along the externally heating rollers 103 and 104. The roller holding frame 206*a* is supported, in a side where it supports one-side end portions of the externally heating rollers 103 and 104 and in an end side extended in an L-shape, by the swingable frame 208 on the same axis so as to enable the end portion rotation.

The roller holding frame 206*b* is an L-shaped member extended from a portion where the end portions of the externally heating rollers 103 and 104 are supported in another side, along the externally heating rollers 103 and 104. The roller holding frame 206*b* is supported, in a side where it supports another-side end portions of the externally heating rollers 103 and 104 and in an end side extended in an L-shape, by the swingable frame 208 on the same axis so as to enable the end portion rotation. Incidentally, the roller holding frames 206*a* and 206*b* are not necessarily required to have the L-shape. In the case where the thermistors 123 and 124 and the like are not provided on the roller holding frames 206*a* and 206*b* or in the like case, the roller holding frames 206 may only be required to be shaft-supported by the swingable frame 208 at an end portion of the swingable frame 208. For that reason, e.g., roller holding frames free from a portion extended from the end portion of the swingable frame 208 along the externally heating rollers 103 and 104 may also be used.

As shown in (b) of FIG. 4, the swingable frame 208 supports the roller holding frames 206*a* and 206*b* so that the roller holding frames 206*a* and 206*b* independently cause the end portion rotation and so that the externally heating rollers 103 and 104 are capable of causing the tilt.

As shown in FIG. 3, an urging spring 204 urges an urging frame 201 toward the fixing roller 101. The pressing mechanism 200 as an example of a contact and separation mechanism moves the swingable frame 208 against the urging spring 204, so that the urging mechanism moves the externally heating belt 105 toward and away from the fixing roller 101 via the externally heating rollers 103 and 104. The belt unit 34 is contactable to and separable from the outer peripheral surface of the fixing roller 101 by the contact and separation mechanism 200. The externally heating rollers 103 and 104 are rotatably supported by the roller holding frames 206 (206*a*, 206*b*) via unshown heat-insulating bush and bearing which have high heat resistance.

As shown in (a) of FIG. 4, the roller holding frame 206 is divided into the front side roller holding frame 206*a* and the rear side roller holding frame 206*b* at a longitudinal central portion of the externally heating rollers 103 and 104. The end portions of the externally heating rollers 103 and 104 in the front side are supported by the roller holding frame 206*a*, and the end portions of the externally heating rollers 103 and 104 in the rear side are supported by the roller holding frame 206*b*.

As shown in (b) of FIG. 4, the roller holding frame 206*a* is supported by the supporting shafts 207*a* and 207*b* so as to be capable of causing the end portion rotation with respect to the swingable frame 208. The roller holding frame 206*b* is supported by the supporting shafts 207*c* and 207*d* so as to be capable of causing the end portion rotation with respect to the swingable frame 208. Incidentally, also the supporting shafts 207 (207*a*, 207*b*, 207*c*, 207*d*) constitute a part of a swing-supporting mechanism and function as shaft portions. When the fixing roller 101 and the externally heating rollers 103 and 104 are substantially parallel to each other, the supporting shafts 207 are substantially parallel to these rollers.

The swingable frame 208 and the supporting shafts 207 (207*a*, 207*b*, 207*c*, 207*d*) function as the swing-supporting mechanism for swingably supporting the roller holding frames 206 (206*a*, 206*b*).

The roller holding frames 206 (206*a*, 206*b*), the swingable frame 208 and the supporting shafts 207 (207*a*, 207*b*, 207*c*, 207*d*) function as a displacing mechanism for permitting the tilt of the externally heating rollers 103 and 104.

With the rotation of the belt unit 34 by the rotating mechanism, the externally heating roller 103 urges the externally heating belt 105 toward the fixing roller 101. The displacing mechanism permits displacement of the externally heating roller 103 in a direction in which urging forces at widthwise end portions of the externally heating belt 105 are equal to each other, that is, in a direction of equalizing them.

With the rotation of the belt unit 34 by the rotating mechanism, the externally heating roller 104 urges the externally heating belt 105 toward the fixing roller 101. The displacing mechanism permits displacement of the externally heating roller 104 in a direction in which urging forces at widthwise end portions of the externally heating belt 105 are equal to each other, that is, in a direction of equalizing them.

That is, the displacing mechanism permits, with the rotation of the belt unit 34 by the rotating mechanism, the displacement of the externally heating rollers 103 and 104 so that the axes of the externally heating rollers 103 and 104 aqre tilted in different directions.

As shown in FIG. 6, the swingable frame 208 contacts an urging arm 117, so as to be capable of causing the unit rotation, via an intermediate roller 210 as a cylindrical rotatable member located at each of end portions of the swingable frame 208. By this constitution, the intermediate roller 210 is rotated with the rotation of the belt unit 34, so that friction between the swingable frame 208 and the urging arm 117 by the unit rotation can be reduced to suppress abrasion (wearing) of these members.

Further, in this case, the intermediate roller 210 is provided in the urging arm 117 side in FIG. 3, but as shown in FIG. 6, the intermediate roller 210 may also be provided as intermediate rollers 210*a* and 210*b* rotatably supported by the supporting shafts 207*a* and 207*d* in the belt unit 34 side. At this time, the intermediate rollers 210*a* and 210*b* function as first and second rotatable members. Further, in this constitution, an effect such that the influence on the end portion rotation of the roller holding frames 206*a* and 206*b* can be reduced can be obtained. That is, natural end portion rotation of the roller holding frames 206*a* and 206*b* generated by the unit rotation is not prevented.

As shown in FIG. 6, the contact and separation mechanism 200 also functions as the urging (pressing) mechanism for causing the belt unit 34 to press-contact the fixing roller 101. The urging arm 117 is provided integrally with the urging frame 201 at each of longitudinal end portions of the urging frame 201. Further, the urging arm 117 is rotatably movable (rotatable) about the supporting shaft 203 relative to a casing frame 9*f* of the fixing device 9. Hereinafter, this rotational movement (rotation) is referred to as arm rotational movement (arm rotation). The urging spring 204 is disposed between an arm rotation end of the urging arm 117 and the casing frame 9*f* of the fixing device 9. The urging spring 204 presses down the arm rotation end of the urging arm 117 provided at each of the end portions of the urging frame 201 to cause the arm rotation of the urging arm 117 about the supporting shaft 203. Then, the urging arm 117 is contacted to the intermediate roller 210 to urge the intermediate roller 210.

Therefore, the urging spring 204, the urging frame 201 and the urging arm 117 function as a first urging member for urging the intermediate roller 210*a* as the first rotatable member in contact with the intermediate roller 210*a* in one longitudinal end side of these members. Further, these members function as a second urging member for urging the intermediate roller 210*b* as the second rotatable member in contact with the intermediate roller 210*b* in another longitudinal end side thereof.

By this constitution, the roller holding frames 206 (206*a*, 206*b*) are urged via the intermediate rollers 210 (210*a*, 210*b*), so that the externally heating rollers 103 and 104 are urged toward the fixing roller 101 via the roller holding frames 206 (206*a* and 206*b*). Accordingly, in a state in which the externally heating belt 105 is contacted to the fixing roller 101 by the externally heating rollers 103 and 104, the urging spring 204 urging the externally heating rollers 103 and 104 toward the fixing roller 101 at total pressure of 392N (about 40 kgf).

The pressure releasing cam 205 is contacted to a lower surface of the rotation end of the urging arm 117 with the supporting shaft 203 as the rotation center. The controller 140 raises and lowers the arm rotation end of the urging arm 117 by controlling a motor 211 to cause the arm rotation of the urging arm 117 about the rotation shaft 205*a*.

When the pressure releasing cam 205 is spaced from the urging arm 117, the urging spring 204 presses down the arm rotation end of the urging arm 117, so that the externally heating rollers 103 and 104 are press-contacted to the fixing roller 101. When the pressure releasing cam 205 compresses the urging spring 204 to press up the urging arm 117, the externally heating rollers 103 and 104 are spaced from the fixing roller 101.

During start of the image formation, the pressure releasing cam 205 is rotated to rotate the urging arm 117 in an arrow a direction, so that the swingable frame 208 is moved in the direction of the fixing roller 101. With this movement, movement of the externally heating rollers 103 and 104, supported at end portions thereof by the roller holding frames 206, in the direction of the fixing roller 101 is started. Then, when the externally heating belt 105 is press-contacted to the fixing roller 101 by the externally heating rollers 103 and 104, the externally heating rollers 103 and 104 are urged toward the fixing roller 101. Thus, movement of the externally heating rollers 103 and 104, toward the fixing roller 101, together with the externally heating belt 105 is started.

After end of the image formation, by rotating the pressure releasing cam 205 in an opposite direction, an operation in a reverse order to that during the start of the image formation is performed to return the belt unit 34 to an original state in which the belt unit 34 is spaced from the fixing roller 101. Then, this state is maintained until a subsequent image forming job is received.

As described above, the urging spring 204, the urging frame 201 and the urging arm 117 function as the first and second urging members. Further, the urging arm 117 urges the externally heating rollers 103 and 104 toward the fixing roller 101 via the intermediate rollers 210 (210*a*, 210*b*) as a pair of cylindrical rotatable members provided in the front side and the rear side of the belt unit 34. The urging arm 117 is capable of urging the externally heating rollers 103 and 104 by the rotation of the intermediate rollers 210 irrespective of the state of the unit rotation. Accordingly, the urging frame 201, the urging arm 117, the intermediate rollers 210, the supporting shaft 207 and the urging spring 204 function as the urging mechanism for urging the belt unit 34 toward the fixing roller 101.

The belt unit 34 urged by the urging mechanism from the end portions thereof receives the reaction from the fixing roller 101 in a larger amount. For that reason, the externally heating rollers 103 and 104 further reliably cause the tilt.

Next, an effect of the case where the externally heating rollers 103 and 104 are held so as to permit the tilt as in this embodiment will be verified.

In this embodiment, with the unit rotation of the belt unit 34, the roller holding frames 206*a* and 206*b* cause the end portion rotations in the opposite directions. As a result, the externally heating rollers 103 and 104 cause the tilt. Accordingly, the pressures applied from the externally heating rollers 103 and 104 to the fixing roller 101 at the end portions are dispersed and averaged.

Consideration will be made based on a comparison example in which the roller holding frames 206*a* and 206*b* are, different from this embodiment, integrally fixed so as not to permit the end portion rotations in the opposite directions. In such a comparison example, the externally heating belt 105 is contacted to the fixing roller 101 at an end portion thereof by the externally heating rollers 103 and 104.

In the comparison example shown in (a) of FIG. 15, in the case where the fixing roller 101 and the externally heating rollers 103 and 104 have the steering angle θ, either of the externally heating rollers 103 and 104 is raised from the fixing roller 101 in the rear side or the front side. Even in the case where if the externally heating belt 105 is press-contacted to the fixing roller 101 by the externally heating rollers 103 and 104 at uniform pressure, in the front side, the pressure is concentrated at one of the externally heating rollers 103 and 104 and thus the other one of the externally heating rollers 103 and 104 is raised (spaced) from the fixing roller 101. On the other hand, when the externally heating belt 105 is press-contacted to the fixing roller 101 in the front side by the externally heating rollers 103 and 104 at uniform pressure, in the rear side, the pressure is concentrated at one of the externally heating rollers 103 and 104 and thus the other one of the externally heating rollers 103 and 104 is raised (spaced) from the fixing roller 101.

In the comparison example shown in (a) of FIG. 16, the externally heating rollers 103 and 104 are fixed so that attitudes thereof are parallel to each other, and therefore the attitudes of the externally heating rollers 103 and 104 cannot be changed to tilt positions depending on a curved surface of the fixing roller 101. For that reason, when the externally heating belt 105 is contacted to the fixing roller 101 at the end portions thereof by the externally heating rollers 103 and 104, the pressure is concentrated at the externally heating roller 103 in the pressure and is concentrate at the externally heating roller 104 in the front side. Incidentally, in FIG. 16, "HIGH" represents the high pressure, and "LOW" represents the low pressure. For that reason, in the rear side, external heating by the externally heating roller 104 becomes insufficient, and in the front side, external heating by the externally heating roller 103 becomes insufficient. Accordingly, an occurrence of temperature non-uniformity of the fixing roller 101 with respect to the rotational axis direction (longitudinal direction) was invited.

In this embodiment (First Embodiment) shown in (b) of FIG. 15, even when the fixing roller 101 and the externally heating rollers 103 and 104 have the steering angle θ, the externally heating belt 105 is contacted substantially uniformly to the fixing roller 101 in both of the rear side and the front side of the fixing roller 101. When a difference in pressure is generated between the externally heating rollers 103 and 104, the front side roller holding frame 206*a* and the rear side roller holding frame 206*b* are autonomously rotated to cancel the pressure difference. The front side roller holding frame 206*a* and the rear side roller holding frame 206*b* are rotated relative to each other, so that the attitudes of the externally heating rollers 103 and 104 are changed to the tilt positions depending on the curved surface of the fixing roller 101.

In this embodiment shown in (b) of FIG. 16, a relative tilt angle between the externally heating rollers 103 and 104 is changeable, and therefore the attitudes of the externally heating rollers 103 and 104 are automatically corrected to the tilt positions depending on the curved surface of the fixing roller 101. For that reason, both of the externally heating rollers 103 and 104 are contacted uniformly to the fixing roller 101, so that the external heating from the externally heating rollers 103 and 104 to the fixing roller 101 is sufficiently made in not only the front side but also the rear side, and thus the fixing roller 101 less causes the temperature non-uniformity with respect to the rotational axis direction thereof.

In the constitution in the comparison example, the steering angle θ between the fixing roller 101 and the externally heating rollers 103 and 104 was set at 1 degree, and then the externally heating belt 105 was press-contacted to the fixing roller 101 by the externally heating rollers 103 and 104 at the total pressure of 392N (about 40 kgf). In this state, a pressure distribution was measured at nips N2 and N3, of the contact portion Ne, where the externally heating belt 105 is sandwiched between the fixing roller 101 and the externally heating rollers 103 and 104. As a result, as shown in (a) of FIG. 17, with respect to the externally heating roller 103, a pressure peak was formed at a front side end portion thereof, and with respect to the externally heating roller 104, a pressure peak was formed at a rear side end portion thereof. That is, with respect to the rotational axis direction of the fixing roller 101, a balance of pressure between the front side and the rear side became non-uniform.

In the constitution in this embodiment, the steering angle θ between the fixing roller 101 and the externally heating rollers 103 and 104 was set at 1 degree, and then the externally heating belt 105 was press-contacted to the fixing roller 101 by the externally heating rollers 103 and 104 at the total pressure of 392N (about 40 kgf). In this state, the pressure distribution was measured at the nips N2 and N3 each formed between the externally heating belt 105 and the fixing roller 101. As a result, as shown in (b) of FIG. 17, with respect to both of the externally heating rollers 103 and 104, the substantially same a pressure peak was formed at a front side end portion thereof and at a rear side end portion thereof. That is, with respect to the rotational axis direction of the fixing roller 101, a balance of pressure between the front side and the rear side became substantially uniform.

In the constitution in this embodiment, when the externally heating unit (belt unit) 34 is contacted to the fixing roller 101 at the crossing angle θ, the pressure peak positions of the externally heating rollers 103 and 104 are influenced by a position where the belt unit 34 is urged. In this embodiment, as shown in (b) of FIG. 4, a constitution in which the urging spring 204 urges the externally heating rollers 103 and 104 at end portions is employed. Accordingly, in the case where the pressure (urging force) of the urging spring 204 is large, flexure is generated in the externally heating rollers 103 and 104, so that the pressure at the longitudinal central portion becomes small compared with the pressure at the longitudinal end portions, and therefore the pressure peak is generated at the end portions.

Further, in the case a degree of the influence of the flexure of the externally heating rollers 103 and 104 is small, by the influence of the shape of the fixing roller 101, the pressure peak is generated at the longitudinal central portion of the externally heating rollers 103 and 104.

That is, in this constitution, irrespective of a magnitude of the pressure of the urging spring 204, it can be said that the pressure distribution of the externally heating rollers 103 and 104 is symmetrically extended on the basis of the center of the rollers with respect to the rotational axis direction. Accordingly, by optimizing a combination of values of elastic modulus (elasticity coefficient) of the urging springs 204 (204*a*, 204*b*), the externally heating rollers 103 and 104 are capable of forming a substantially uniform pressure distribution over the entire region thereof with respect to the rotational axis direction.

It is confirmed that there is a relationship between the pressure applied from the belt unit 34 to the fixing roller 101 and the amount of heat supplied from the belt unit 34 to the fixing roller 101. When the belt unit 34 is contacted to the fixing roller 101 at the pressure, the elastic layer 101*b* of the fixing roller 101 is deformed correspondingly to the shapes of the externally heating rollers 103 and 104, and therefore a nip width of each of the nips N2 and N3 is broaden, so that a contact length of the contact portion Ne also becomes long. For that reason, the amount of heat supplied from the belt unit 34 to the fixing roller 101 becomes large.

Accordingly, when the pressures of the externally heating rollers 103 and 104 are different from each other in the position with respect to the rotational axis direction, the nip widths of the nips N2 and N3 in the position with respect to the rotational axis direction are different from each other. Accordingly, also the contact length of the contact portion Ne along the movement direction of the rotational axis direction is also different in the position with respect to the belt widthwise direction.

Next, continuous heat treatment of the recording material was performed by the fixing device in the comparison example and by the fixing device in this embodiment, and then temperature distributions of the fixing rollers 101 in the comparison example and in this embodiment with respect to the rotational axis direction were compared. The steering angle between the fixing roller 101 and the externally heating rollers 103 and 104 was set at 1 degree, and then the externally heating belt 105 was press-contacted to the fixing roller 101 by the externally heating rollers 103 and 104 at the total pressure of 392N (about 40 kgf). In this state, in a process in which sheets of A3-sized thick coated paper having a basis weight of 300 g/m$^2$ were heat-treated with productivity of 70 sheets/minute, a minimum temperature was measured at each of a front side portion, a central portion and a rear side portion of the fixing roller 101 with respected to the rotational axis direction.

TABLE 1

| CN*1 | Comparison Example | | | First Embodiment | | |
|---|---|---|---|---|---|---|
| EH*2 | EHB | | | EHB | | |
| RHF*3 | Integral | | | Relative | | |
| MT*4 | (F) | (C) | (R) | (F) | (C) | (R) |
| | 157.6 | 161.8 | 167.3 | 164.1 | 163.2 | 165.5 |

*1"CN" represents constitution.

*2"EH" represents external heating. The externally heating belt ("EHB") was used in both of the comparison example and First Embodiment.

*3"RHF" represents the roller holding frames. In the comparison example, the roller holding frames were integrally fixed. In First Embodiment, the roller holding frames were rotatable relative to each other.

*4"MT" represents the minimum temperature. "(F)" is the front side portion, "(C)" is the central portion, and "(R)" is the rear side portion.

In the fixing device in First Embodiment, in the case where the belt unit 34 is contacted to the fixing roller 101 at the steering angle θ, there is the following feature. The pressure distribution of the externally heating rollers 103 and 104 with respect to the fixing roller 101 is substantially uniform between the front side and the rear side with respect to the rotational axis direction. Further, the contact length of the contact portion Ne along the movement direction of the externally heating belt 105 is substantially uniform between the front side and the rear side. Accordingly, as shown in Table 1, it is possible to supply the amount of heat to the front side and the rear side of the fixing roller 101 while satisfactorily achieving a balance, so that it is possible to improve a degree of gloss fluctuation (uneven gloss) or the like of an output image.

On the other hand, in the fixing device in the comparison example, in the case where the belt unit 34 is contacted to the fixing roller at the steering angle θ, there is the following feature. The pressure distribution of the externally heating rollers 103 and 104 with respect to the fixing roller 101 is out of balance between the front side and the rear side of the rotational axis direction. Further, the contact length of the contact portion Ne along the movement direction of the externally heating belt 105 causes non-uniformity between the front side and the rear side of the belt widthwise direction.

According to this embodiment, when the fixing roller 101 and the belt unit 34 are in contact with each other at the steering angle θ by the rotating mechanism, it is possible to reduce the pressure difference between the widthwise end sides of the externally heating belt 105 contacted to the fixing roller 101.

According to this embodiment, when the fixing roller 101 and the belt unit 34 are in contact with each other at the steering angle θ, by satisfactorily using the reaction from the fixing roller 101, each of the externally heating rollers 103 and 104 is caused to effect the tilt.

According to this embodiment, when the fixing roller 101 and the belt unit 34 are in contact with each other at the steering angle θ, the pressure distribution of the externally heating belt 105 with respect to the fixing roller 101 is substantially symmetrical on the basis of the substantially central portion of the externally heating rollers with respect to the rotational axis direction. For that reason, the urging springs 204 for urging the end portions of the belt unit 34 in order to bring the pressure distribution close to a substantially uniform pressure distribution with respect to the longitudinal direction can be easily adjusted.

According to this embodiment, when the fixing roller 101 and the belt unit 34 are in contact with each other at the steering angle θ, the reaction from the fixing roller 101 to the externally heating belt 105 is efficiently adjusted. That is, an operation for decreasing the reaction from the fixing roller 101 in a region, where the reaction is large, of the contact portion Ne of the fixing roller 101 is also an operation for increasing the reaction from the fixing roller 101 in a region where the reaction is small. Accordingly, a force necessary to cause the tilt of the externally heating rollers 103 and 104 may only be required to be small.

According to this embodiment, when the steering θ between the fixing roller 101 and the belt unit 34 is changed by the rotating mechanism, the tilt angle α is changed depending on the change in steering angle θ. For that reason, the longitudinal pressure distribution of the fixing roller 101 is stabilized irrespective of the change in steering angle θ.

Based on the above-described features, according to the present invention, it is possible to improve not only travelling stability of the endless belt but also a contact state of the belt contacted to the rotatable heating member. Further, the heat amount (quantity) to be supplied to the surface of the fixing roller 101 can be stably supplied from the front side to the rear side of the rotational axis direction of the fixing roller 101. Further, by stabilizing the surface temperature of the fixing roller 101 from the front side to the rear side of the rotational axis direction of the fixing roller 101, a fixing property of a color image is made uniform in a plane of the recording material, so that it is possible to remedy the image defect such as the gloss fluctuation (uneven gloss) of the fixed image. Accordingly, it is possible to provide the output image with a high fixing quality.

Second Embodiment

FIG. 19 is an illustration of a cylinder-type holding mechanism 300 in Second Embodiment.

In this embodiment, in place of the roller holding frames 206 (206*a*, 206*b*) in First Embodiment, the cylinder-type holding mechanisms 300 (300*a*, 300*b*) are provided at end portions of the externally heating rollers 103 and 104 in one end side and in another end side, respectively, with respect to the rotational axis direction. Incidentally, in this embodiment, constituent elements other than the cylinder-type holding mechanisms 300 are the same as those in First Embodiment.

Therefore, the constituent elements common to First Embodiment and this embodiment are represented by the same reference numeral or symbols in FIG. 19 and will be omitted from redundant description. Incidentally, in FIG. 19, the externally heating belt 105 is omitted from illustration.

As shown in FIG. 19, the cylinder-type holding mechanism 300*a* as an example of a first holding member rotatably hold (support) the end portions of the externally heating rollers 103 and 104 in one end side with respect to the rotational axis direction. The cylinder type holding mechanism 300*b* as an example of a second holding member rotatably hold (support) the end portions of the externally heating rollers 103 and 104 in another end side with respect to the rotational axis direction.

Further, the cylinder-type holding mechanisms 300 are fixed and supported by the swingable frame 208.

Accordingly, the displacing mechanism in this embodiment includes the cylinder-type holding mechanisms 300 (300*a*, 300*b*) and the swingable frame 208.

The cylinder-type holding mechanism 300*a* will be described specifically with reference to FIG. 19. Holders 341*a* and 342*a* rotatably hold the externally heating rollers 103 and 104 in one end side with respect to the belt widthwise direction. Piston rods 331*a* and 332*a* are connected to the holders 341*a* and 342*a*, respectively. Pistons 321*a* and 322*a* are connected to the piston rods 331*a* and 332*a*, respectively. Further, the pistons 321*a* and 322*a* are moved along an inner surface of a cylinder tube 310*a*, thus changing pressure inside the cylinder tube 310*a*.

In another end side of the externally heating rollers 103 and 104 with respect to the rotational axis direction, the cylinder-type holding mechanism 300*b* is constituted similarly as in the cylinder-type holding mechanism 300*a*.

As described in First Embodiment, in the case where the fixing roller 101 and the belt unit 34 have the steering angle θ, in the rear side and the front side of the fixing roller 101, the externally heating rollers 103 and 104 receive forces so that the externally heating belt (not shown) is contacted to the fixing roller 101 at one end portion. That is, the pressure in one end side of the externally heating roller 103 with respect to the fixing roller 101 is strengthened, and the pressure in another end side is weakened. Further, the pressure in one end side of the externally heating roller 104 with respect to the fixing roller 101 is weakened, and the pressure in another end side is strengthened. In such a case, the cylinder-type holding mechanism 300 is operated in the following manner.

In one end side of the externally heating roller 103 which received the reaction from the fixing roller 101, the piston 321*a* is moved in an inward direction of the cylinder tube 310*a* via the holder 341*a* and the piston rod 331*a*. The cylinder tube 310*a* in which the inside pressure is increased by the movement of the piston 321*a* moves the piston 322*a* in an outward direction. The piston 322*a* urges the externally heating roller 104 toward the fixing roller 101 in one end side via the piston rod 332*a* and the holder 342*a*. Then, the reaction from the fixing roller 101 to the externally heating rollers 103 and 104 in one end side and the pressure applied from the cylinder tube 310*a* to the pistons 321*a* and 322*a* achieve a balance, so that the operation of the cylinder-type holding mechanism 300*a* is ended.

Also the cylinder-type holding mechanism 300*b* is similarly operated in another end side of the externally heating rollers 103 and 104.

By the above constitution, the cylinder-type holding mechanisms 300*a* and 300*b* alternately raise and lower the end portions of the externally heating rollers 103 and 104. As a result, the externally heating rollers 103 and 104 are displaced so as to cause the tilt.

According to this embodiment, when the fixing roller 101 and the belt unit 34 are in contact with each other at the steering angle θ, effects similar to those in First Embodiment is achieved. Accordingly, the effect of reducing the pressure difference between the widthwise end sides of the externally heating belt 105 contacted to the fixing roller 101 is achieved. The effect of reducing a degree of non-uniformity, in the position with respect to the belt widthwise direction, of the contact length of the externally heating belt 105 along the movement direction of the externally heating belt 105 is achieved. The effect of causing the tilt of each of the externally heating rollers 103 and 104 by using the reaction from the fixing roller is achieved. The effect of causing the tilt of each of the externally heating rollers 103 and 104 with a small force is achieved. The effect of easily adjusting the pressure distribution of the externally heating belt 105 by the adjustment of the urging spring 204 is achieved. The effect of stabilizing the pressure distribution of the externally heating belt 105 irrespective of the change in steering angle θ is achieved.

By the above-described effects, it is possible to improve not only the travelling stability of the endless belt but also the contact state of the belt contacted to the rotatable heating member. Further, the fixing property of the color image is made substantially uniform in the plane of the recording material, so that it is possible to remedy the image defect such as the gloss fluctuation (uneven gloss) of the fixed image. Accordingly, it is possible to provide the output image with the high fixing quality.

However, the constitution in First Embodiment is preferable from the viewpoints of a simple mechanism and a small number of parts. Further, the above-described members are used in the externally heating unit, and therefore the constitution of First Embodiment with less influence of heat is preferable.

Third Embodiment

FIG. 20 is an illustration of a tilt holding frame mechanism 400 in Third Embodiment.

In this embodiment, in place of the roller holding frames 206 (206*a*, 206*b*) in First Embodiment, tilt holding frame mechanisms 401 and 402 are provided along a longitudinal direction. Incidentally, in this embodiment, constituent elements other than the tilt holding frames 401 and 402 and a tilt supporting shaft 410 are the same as those in First Embodiment.

Therefore, the constituent elements common to First Embodiment and this embodiment are represented by the same reference numeral or symbols in FIG. 20 and will be omitted from redundant description. Incidentally, in FIG. 20, the externally heating belt 105 is omitted from illustration.

As shown in FIG. 20, the tilt holding frame mechanism 400 as an example of the displacing mechanism includes the tilt holding frames 401 and 402 and the tilt supporting shaft 410.

The tilt holding frame 401 rotatably holds end portions of the externally heating roller 103. The tilt holding frame 402 rotatably holds end portions of the externally heating roller 104. The tilt supporting shaft 410 supports the tilt holding frames 401 and 402 so as to capable of causing the tilt.

As described in First Embodiment, in the case where the fixing roller 101 and the belt unit 34 have the steering angle θ, in the rear side and the front side of the fixing roller 101, the externally heating rollers 103 and 104 receive forces so that the externally heating belt (not shown) is contacted to the fixing roller 101 at one end portion. That is, the pressure in one end side of the externally heating roller 103 with respect to the fixing roller 101 is strengthened, and the pressure in another end side is weakened. Further, the pressure in one end side of the externally heating roller 104 with respect to the fixing roller 101 is weakened, and the pressure in another end side is strengthened. In such a case, the tilt holding frame mechanism 400 is operated in the following manner.

By the reaction from the fixing roller 101, the externally heating roller 103 is displaced in an upward direction in FIG. 20 in one end side. With this displacement, the tilt holding frame 401 is pressed up in one end side. By the pressing-up of the tilt holding frame 401 in one end side, the tilt holding frame 401 causes the tilt about the supporting shaft 410. The tilt holding frame 401 which caused the tilt is displaced in a downward direction in FIG. 20 in another end side. With this displacement, the externally heating roller 103 is pressed down in another end side.

By the above constitution, the tilt holding frame mechanism 400 alternately raises and lowers the end portions of the externally heating rollers 103 and 104. As a result, the externally heating rollers 103 and 104 are displaced so as to cause the tilt.

According to this embodiment, when the fixing roller 101 and the belt unit 34 are in contact with each other at the steering angle θ, effects similar to those in First Embodiment is achieved. Accordingly, the effect of reducing the pressure difference between the widthwise end sides of the externally heating belt 105 contacted to the fixing roller 101 is achieved. The effect of reducing a degree of non-uniformity, in the position with respect to the belt widthwise direction, of the contact length of the externally heating belt 105 along the movement direction of the externally heating belt 105 is achieved. The effect of causing the tilt of each of the externally heating rollers 103 and 104 by using the reaction from the fixing roller is achieved. The effect of causing the tilt of each of the externally heating rollers 103 and 104 with a small force is achieved. The effect of easily adjusting the pressure distribution of the externally heating belt 105 by the adjustment of the urging spring 204 is achieved. The effect of stabilizing the pressure distribution of the externally heating belt 105 irrespective of the change in steering angle θ is achieved.

By the above-described effects, it is possible to improve not only the travelling stability of the endless belt but also the contact state of the belt contacted to the rotatable heating member. Further, the fixing property of the color image is made substantially uniform in the plane of the recording material, so that it is possible to remedy the image defect such as the gloss fluctuation (uneven gloss) of the fixed image. Accordingly, it is possible to provide the output image with the high fixing quality.

However, the constitution in First Embodiment is preferable from the viewpoint of strength design in view of a short distance from the supporting shaft 410 (supporting shaft 207) for receiving the urging force to the externally heating roller end portion. Further, the constitution in First Embodiment is preferable from the viewpoint that a balance of urging pressures to the externally heating rollers 103 and 104 can be adjusted.

Fourth Embodiment

FIG. 20 is an illustration of a tilt skeleton mechanism 500 in Fourth Embodiment.

In this embodiment, in place of the externally heating rollers 103 and 104 held at end portions thereof by the roller holding frames 206, divided rollers 103*a*, 103*b*, 104*a* and 104*b* are provided. Further, the divided rollers 103*a*, 103*b*, 104*a* and 104*b* are supported by the tilt skeleton mechanism 500 provided inside the externally heating belt 105. Incidentally, in this embodiment, constituent elements other than the tilt skeleton mechanism 500 and the divided rollers 103*a*, 103*b*, 104*a* and 104*b* are the same as those in First Embodiment.

Therefore, the constituent elements common to First Embodiment and this embodiment will be omitted from redundant description.

As shown in FIG. 21, the tilt skeleton mechanism 500 as an example of the displacing mechanism rotatably supports the divided rollers 103*a*, 103*b*, 104*a* and 104*b*. The divided rollers 103*a*, 103*b*, 104*a* and 104*a* rotatably stretch the externally heating belt 105 and are rotated by rotation of the externally heating belt 105.

A constitution of the tilt skeleton mechanism 500 will be described specifically. A roller shaft 501 rotatably supports the divided rollers 103*a* and 103*b*. A roller shaft 502 rotatably supports the divided rollers 104*a* and 104*b*. Shaft holding members 511 and 512 hold the roller shafts 501 and 502, respectively, and extend along an X axis in FIG. 18. A connecting member 530 rotatably holds the shaft holding members 511 and 512 so that the roller shafts 501 and 502 are capable of causing the tilt. A handle portion 531 extended from the connecting member 530 along the belt widthwise direction is swung by the rotating mechanism similarly as the supporting shaft 207 in First Embodiment to cause the unit rotation of the tilt skeleton mechanism 500.

Incidentally, the shaft holding members 511 and 512 may also stretch the externally heating belt 105 by being shaped to have the same diameter as the divided rollers 103*a*, 103*b*, 104*a* and 104*b*.

Accordingly, the belt unit 34 in this embodiment includes the roller shafts 501 and 502, the divided rollers 103*a*, 103*b*, 104*a* and 104*b*, and the externally heating belt 105.

Further, the displacing mechanism in this embodiment includes the shaft holding members 511 and 512 and the connecting member 530.

As described in First Embodiment, in the case where the fixing roller 101 and the belt unit 34 have the steering angle θ, in the rear side and the front side of the fixing roller 101, the divided rollers 103*a*, 103*b*, 104*a* and 104*b* receive forces so that the externally heating belt (not shown) is contacted to the fixing roller 101 at one end portion. That is, the pressure of the divided roller 103*a* with respect to the fixing roller 101 is strengthened, and the pressure of the divided roller 103*b* is weakened. Further, the pressure of the divided roller 104*a* with respect to the fixing roller 101 is weakened, and the pressure of the divided roller 104*b* is strengthened. In such a case, the tilt skeleton mechanism 500 is operated in the following manner.

By the reaction from the fixing roller 101, the divided roller 103*a* is displaced in an upward direction in FIG. 21. With this displacement, the roller shaft 501 is pressed up in one end side. By the pressing-up of the roller shaft 501 in one end side, the roller shaft 501 causes the tilt about the shaft holding member 511. The roller shaft 501 which caused the tilt about the shaft holding member 511 is displaced in a downward direction in FIG. 21 in another end side. With this displacement, the divided roller 103*b* is pressed down.

By the reaction from the fixing roller 101, the divided roller 104*a* is displaced in an upward direction in FIG. 21. With this displacement, the roller shaft 502 is pressed up in another end side. By the pressing-up of the roller shaft 502 in another end side, the roller shaft 502 causes the tilt about the shaft holding member 512. The roller shaft 502 which caused the tilt about the shaft holding member 512 is displaced in a downward direction in FIG. 21 in one end side. With this displacement, the divided roller 104*b* is pressed down.

By the above constitution, the tilt skeleton mechanism 500 alternately raises and lowers the end portions of the roller shafts 501 and 502. As a result, the roller shafts 501 and 502 are displaced so as to cause the tilt.

According to this embodiment, when the fixing roller 101 and the belt unit 34 are in contact with each other at the steering angle θ, effects similar to those in First Embodiment is achieved. Accordingly, the effect of reducing the pressure difference between the widthwise end sides of the externally heating belt 105 contacted to the fixing roller 101 is achieved. The effect of reducing a degree of non-uniformity, in the position with respect to the belt widthwise direction, of the contact length of the externally heating belt 105 along the movement direction of the externally heating belt 105 is achieved. The effect of causing the tilt of each of the externally heating rollers 103 and 104 by using the reaction from the fixing roller is achieved. The effect of causing the tilt of each of the roller shaft 501 and 502 with a small force is achieved. The effect of easily adjusting the pressure distribution of the externally heating belt 105 by the adjustment of the urging spring 204 is achieved. The effect of stabilizing the pressure distribution of the externally heating belt 105 irrespective of the change in steering angle θ is achieved.

By the above-described effects, it is possible to improve not only the travelling stability of the endless belt but also the contact state of the belt contacted to the rotatable heating member. Further, the fixing property of the color image is made substantially uniform in the plane of the recording material, so that it is possible to remedy the image defect such as the gloss fluctuation (uneven gloss) of the fixed image. Accordingly, it is possible to provide the output image with the high fixing quality.

However, the constitution in First Embodiment is preferable from the viewpoint that the handle portions 531 and 532 do not interfere with the belt 105. Further, the constitution in First Embodiment is preferable from the viewpoint of strength design since the urging force can be dispersed to the end portions of the externally heating rollers 103 and 104 when the belt unit 34 is urged. Further, the constitution in First Embodiment is preferable from the viewpoint that there is no influence on an image quality due to seams each between the divided roller and the shaft holding member.

Other Embodiments

Parts (a) and (b) of FIG. 22 are illustrations of roller holding frames of an integral type and a connection type, respectively, in other embodiments. FIG. 23 is an illustration of a roller holding frame in another embodiment.

In the above, First to Fourth Embodiments are described, but the constitutions for carrying out the present invention are not limited to those in these embodiments. If the supporting member for supporting the belt unit to be contacted to the rotatable heating member is supported so that the supporting member can provide the tilt angle α depending on the change in steering angle θ, other constitutions may also be employed.

In First Embodiment, the roller holding frames 206 (206*a*, 206*b*), the swingable frame 208, and the supporting shafts 207 (207*a*, 207*b*, 207*c*, 207*d*) function as the displacing mechanism. Further, each of the roller holding frames 206*a* and 206*b* is made capable of causing the end portion rotation by rotation about the shaft, but the constitution of the displacing mechanism is not limited to this constitution. The displacing mechanism may only be required to cause, as a result, deformation of the belt unit along the peripheral surface of the fixing roller 101, and may also employ the following constitutions.

For example, as shown in (a) of FIG. 22, a constitution in which low-rigidity frames 206*c* and 206*d* are used in place of the supporting shafts 207 (207*a*, 207*b*, 207*c*, 207*d*) may be employed. Even in this constitution, the roller holding frames 206 (206*a*, 206*b*) are supported so as to be capable of causing the end portion rotation. Specifically, the roller holding frames 206 (206*a*, 206*b*) which received the reaction from the fixing roller 101 are displaced along the peripheral surface of the fixing roller 101 to deform the low-rigidity frames 206*c* and 206*d*. As a result, the roller holding frames 206 (206*a*, 206*b*) causes the end portion rotation. In this case, the roller holding frames 206 (206*a*, 206*b*) are the same as those in First Embodiment except that these frames are supported by the low-rigidity frames 206*c* and 206*d*.

For example, as shown in (b) of FIG. 22, a constitution in which a pair of round bars 206*c* and 206*d* are used in place of the supporting shafts 207 (207*a*, 207*b*, 207*c*, 207*d*) may be employed. Even in this constitution, the roller holding frames 206 (206*a*, 206*b*) are supported so as to be capable of causing the end portion rotation. Specifically, the roller holding frames 206 (206*a*, 206*b*) which received the reaction from the fixing roller 101 are displaced along the peripheral surface of the fixing roller 101 to pressure and idle the pair of round bars frames 206*c* and 206*d*. As a result, the roller holding frames 206 (206*a*, 206*b*) causes the end portion rotation. In this case, the roller holding frames 206 (206*a*, 206*b*) are the same as those in First Embodiment except that these frames are supported by the pair of round bars 206*c* and 206*d*.

For example, as shown in FIG. 23, in place of the roller holding frames 206 (206*a*, 206*b*) causing the end portion rotation, holding frames 206 (206*a*, 206*b*) for swingably supporting end portions of the externally heating rollers by using an elastic member such as a spring may also be used. By this constitution, the externally heating rollers 103 and 104 are raised and lowered at end portions thereof in one end side and another end side so as to be displaced along the peripheral surface of the fixing roller 101. As a result, the belt unit 34 is displaced along the peripheral surface of the fixing roller 101. In this case, the roller holding frames 206 (206*a*, 206*b*) are the same as those in First Embodiment except that these frames are fixed on and supported by the swingable frame and that the externally heating rollers 103 and 104 are held via the elastic member.

However, in the constitution in other embodiments described above, with respect to a tilting force for the externally heating rollers 103 and 104, the reaction of rigidity of the bearing plate and the reaction with expansion and contraction of the elastic member are received by the externally heating rollers 103 and 104, and therefore in order to cause the tilt of the externally heating rollers 103 and 104, a larger force than that in First Embodiment is required. Accordingly, the constitution in First Embodiment is preferable.

Further, the force for causing the tilt of the externally heating rollers 103 and 104 may also be generated by an external driving source. For example, a constitution in which the supporting shaft 207 in First Embodiment is actively rotated by the motor may also be employed.

However, in the case where the external driving source is used, control with the rotation of the belt unit is needed, so that an apparatus structure is complicated and thus the number of parts is increased. Accordingly, the constitution in First Embodiment is preferable.

Further, if the externally heating rollers 103 and 104 for supporting the externally heating belt 105 of the belt unit 34 to be contacted to the rotatable heating member are supported so as to be capable of causing the tilt by the displacing mechanism and does not influence this constitution, another constitutional element may also be added.

Accordingly, the supporting member for supporting the belt unit 34 is not limited to the two externally heating rollers 103 and 104. For example, if a constitution in which the supporting member is displaced so as to follow the peripheral surface of the fixing roller 101 is employed, the belt unit may also be provided with two or more rollers or nip pads or the like.

So long as the first supporting member for supporting the pair of rollers at longitudinal end portions in one side and the second supporting member for supporting the pair of rollers at other longitudinal end portions in another side are independently rotated, the present invention can be carried out in another embodiment in which a par or all of constituents in an embodiment are replaced with their alternative constituent elements.

Accordingly, the heating method for the roller and the belt is not limited to the halogen heater. For example, the roller and the belt may also be provided with an induction heating layer, thus being heated through induction heating by AC magnetic flux. The use of the roller and the belt is not limited to the use for heating the rotatable heating member. For example, the roller and belt can be used for the purpose of uniform heating by which a temperature distribution of the rotatable heating member in the rotational axis direction is averaged and for the purpose of cooling for accelerating cooling of the rotatable heating member. The rotatable heating member is not limited to the fixing roller. For example, the rotatable heating member may also be the pressing roller for heating the back surface, opposite from the image-formed surface, of the recording material.

The image heating apparatus explained in the above-described embodiments is applicable to, in addition to the fixing device, a surface heating apparatus for adjusting image gloss and a surface property. Further, the image heating apparatus may also be, other than in the constitution in which the image heating apparatus is assembled with the image forming apparatus, carried out as a single apparatus or component which is disposed and operated alone. The image forming apparatus is not limited to the image forming apparatus for forming the full-color image, but may also be an image forming apparatus for forming a monochromatic image. The image heating apparatus can be carried out in the image forming apparatuses in various fields, such as printers, various printing machines, copying machines, facsimile machines and multi-function machines, by adding a device, equipment and a casing structure which are necessary for the image heating apparatus.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 219160/2012 filed Oct. 1, 2012, which is hereby incorporated by reference.

What is claimed is:

1. An image heating apparatus comprising:

a rotatable heating member configured to heat a toner image on a recording material;

a belt unit including an endless belt configured to heat said rotatable heating member in contact with said rotatable heating member and including first and second supporting members configured to rotatably support an inner surface of the belt and configured to urge the belt toward said rotatable heating member;

a detector configured to detect that the belt is deviated from a predetermined zone with respect to a widthwise direction of the belt;

a rotating mechanism configured to rotate, depending on an output of said detector, the belt unit in a direction for returning the belt into the predetermined zone; and a displacing mechanism configured to permit displacement, with rotation of said belt unit by said rotating mechanism, of the first supporting member in a direction of equalizing forces urging the belt toward said rotatable heating member by the first supporting member at widthwise ends of the belt, and configured to permit displacement, with rotation of said belt unit by said rotating mechanism, of the second supporting member in a direction of equalizing forces urging the belt toward said rotatable heating member by the second supporting member at the widthwise ends of the belt.

2. An image heating apparatus according to claim 1, wherein said displacement mechanism includes:

a first holding member configured to hold end portions of the first and second supporting members in a widthwise end side of the first and second supporting members, wherein said first holding member is, with the rotation of said belt unit by said rotating mechanism, swingable in a direction of equalizing forces urging the belt in the widthwise end side toward said rotatable heating member by the first and second supporting members, respectively; and a second holding member configured to hold end portions of the first and second supporting members in another widthwise end side of the first and second supporting members, wherein said second holding member is, with the rotation of said belt unit by said rotating mechanism, swingable in a direction of equalizing forces urging the belt in said another widthwise end side toward said rotatable heating member by the first and second supporting members, respectively.

3. An image heating apparatus according to claim 2, wherein said first and second holding members are rotatable about the same axis.

4. An image heating apparatus according to claim 3, wherein said first and second holding members are rotatable, with the rotation of said belt unit by said rotating mechanism, about the same axis in directions opposite to each other.

5. An image heating apparatus according to claim 2, further comprising:

a swing supporting mechanism configured to swingably support said first and second holding members; and an urging mechanism configured to urge said swing supporting mechanism toward said rotatable heating member.

6. An image heating apparatus according to claim 5, wherein said urging mechanism urges said swing supporting mechanism toward said rotatable heating member at widthwise end portions thereof.

7. An image heating apparatus according to claim 6, wherein said swing supporting mechanism includes a first shaft portion configured to swingably support said first holding member and a second shaft portion configured to swingably supporting said second holding member, and wherein said urging mechanism includes:

a first cylindrical rotatable member rotatably supported by said first shaft portion in an end side;

a second cylindrical rotatable member rotatably supported by said second shaft portion in another end side;

a first urging member configured to urge said first cylindrical rotatable member toward said rotatable heating member in contact with said first cylindrical rotatable member; and a second urging member configured to urge said second cylindrical rotatable member toward said rotatable heating member in contact with said second cylindrical rotatable member, wherein said first and second urging members cause said first and second cylindrical rotatable members, respectively, to be rotated by the rotation of said belt unit by said rotating mechanism.

8. An image heating apparatus according to claim 1, wherein said rotatable heating member is a heating roller configured to urge the belt or a heating belt configured to be urged from an inner surface thereof toward the belt by a roller opposing the belt.

9. An image heating apparatus according to claim 1, wherein the first and second supporting members are first and second supporting rollers, respectively.

10. An image heating apparatus according to claim 9, wherein when an angle formed between a movement direction of said rotatable heating member and a movement direction of the belt at a pressing roller point of contact between said rotatable heating member and the belt is capable of being changed by said rotating mechanism to a first angle and a second angle larger in absolute value than the first angle, an absolute value of a first tilt angle formed between an axis of the first supporting roller and an axis of the second supporting roller when the angle is changed to the first angle is smaller than an absolute value of a second tilt angle formed between the axis of the first supporting roller and the axis of the second supporting roller when the angle is changed to the second angle.

11. An image heating apparatus according to claim 1, wherein said belt unit is rotated, by said rotating mechanism, about an axis located at a substantially central portion of said belt unit with respect to the widthwise direction of the belt.

12. An image heating apparatus according to claim 1, further comprising a driving mechanism configured to rotationally drive said rotatable heating member, wherein the belt is rotated by rotation of said rotatable heating member.

13. An image heating apparatus according to claim 9, wherein in each of the first and second supporting rollers, a heater is incorporated.

14. An image heating apparatus comprising:

a rotatable heating member configured to heat a toner image on a recording material;

a belt unit including an endless belt configured to heat said rotatable heating member in contact with said rotatable heating member and including first and second supporting rollers configured to rotatably support an inner surface of the belt and configured to urge the belt toward said rotatable heating member;

a detector configured to detect that the belt is deviated from a predetermined zone with respect to a widthwise direction of the belt;

a rotating mechanism configured to rotate, depending on an output of said detector, the belt unit in a direction for returning the belt into the predetermined zone;

a first holding member configured to rotatably hold end portions of the first and second supporting rollers in a widthwise end side of the belt; and a second holding member configured to rotatably hold end portions of the first and second supporting rollers in another widthwise end side of the belt, wherein each of said first and second holding members is swingable about an axis substantially parallel to an axis of the first supporting roller when the first and second supporting rollers are parallel to each other.

15. An image heating apparatus according to claim 14, wherein said first and second holding members are rotatable about the same axis.

16. An image heating apparatus according to claim 15, wherein said first and second holding members are rotatable, with the rotation of said belt unit by said rotating mechanism, about the same axis in directions opposite to each other.

17. An image heating apparatus according to claim 14, further comprising:

a swing supporting mechanism configured to swingably support said first and second holding members; and an urging mechanism configured to urge said swing supporting mechanism toward said rotatable heating member.

18. An image heating apparatus according to claim 17, wherein said urging mechanism urges said swing supporting mechanism toward said rotatable heating member at end portions thereof with respect to the widthwise direction of the belt.

19. An image heating apparatus according to claim 18, wherein said swing supporting mechanism includes a first shaft portion configured to swingably support said first holding member and a second shaft portion configured to swingably support said second holding member, and wherein said urging mechanism includes:

a first cylindrical rotatable member rotatably supported by said first shaft portion in an end side;

a second cylindrical rotatable member rotatably supported by said second shaft portion in another end side;

a first urging member configured to urge said first cylindrical rotatable member toward said rotatable heating member in contact with said first cylindrical rotatable member; and a second urging member configured to urge said second cylindrical rotatable member toward said rotatable heating member in contact with said second cylindrical rotatable member, wherein said first and second urging members cause said first and second cylindrical rotatable members, respectively, to be rotated by the rotation of said belt unit by said rotating mechanism.

20. An image heating apparatus according to claim 14, wherein said rotatable heating member is a heating roller configured to urge the belt or a heating belt configured to be urge from an inner surface thereof toward the belt by a roller opposing the belt.

21. An image heating apparatus according to claim 14, wherein when an angle formed between a movement direction of said rotatable heating member and a movement direction of the belt at a pressing roller point of contact between said rotatable heating member and the belt is capable of being changed by said rotating mechanism to a first angle and a second angle larger in absolute value than the first angle, an absolute value of a first tilt angle formed between an axis of the first supporting roller and an axis of the second supporting roller when the angle is changed to the first angle is smaller than an absolute value of a second tilt angle formed between the axis of the first supporting roller and the axis of the second supporting roller when the angle is changed to the second angle.

22. An image heating apparatus according to claim 14, wherein said belt unit is rotated, by said rotating mechanism, about an axis located at a substantially central portion of said belt unit with respect to the widthwise direction of the belt.

23. An image heating apparatus according to claim 14, further comprising a driving mechanism configured to rotationally drive said rotatable heating member, wherein the belt is rotated by rotation of said rotatable heating member.

24. An image heating apparatus according to claim 14, wherein in each of the first and second supporting rollers, a heater is incorporated.

25. An image heating apparatus comprising:

a rotatable heating member configured to heat a toner image on a recording material;

a belt unit including an endless belt configured to heat said rotatable heating member in contact with said rotatable heating member and including first and second supporting rollers configured to rotatably support an inner surface of the belt and configured to urge the belt toward said rotatable heating member;

a detector configured to detect that the belt is deviated from a predetermined zone with respect to a widthwise direction of the belt;

a rotating mechanism configured to rotate, depending on an output of said detector, the belt unit in a direction for returning the belt into the predetermined zone; and a displacing mechanism configured to permit displacement, with rotation of said belt unit by said rotating mechanism, of the first and second supporting rollers so that axes of the first and second supporting rollers are tilted in different direction.

26. An image heating apparatus according to claim 25, wherein said displacement mechanism includes:

a first holding member configured to rotatably hold end portions of the first and second supporting rollers in a widthwise end side of the first and second supporting members, wherein said first holding member is, with the rotation of said belt unit by said rotating mechanism, swingable in a direction of equalizing forces urging the belt in the widthwise end side toward said rotatable heating member by the first and second supporting rollers, respectively; and a second holding member configured to rotatably hold end portions of the first and second supporting rollers in another widthwise end side of the first and second supporting members, wherein said second holding member is, with the rotation of said belt unit by said rotating mechanism, swingable in a direction of equalizing forces urging the belt in said another widthwise end side toward said rotatable heating member by the first and second supporting rollers, respectively.

27. An image heating apparatus according to claim 26, wherein said first and second holding members are rotatable about the same axis.

28. An image heating apparatus according to claim 27, wherein said first and second holding members are rotatable, with the rotation of said belt unit by said rotating mechanism, about the same axis in directions opposite to each other.

29. An image heating apparatus according to claim 25, further comprising:

a swing supporting mechanism configured to swingably support said first and second holding members; and an urging mechanism configured to said swing supporting mechanism toward said rotatable heating member.

30. An image heating apparatus according to claim 29, wherein said urging mechanism urges said swing supporting mechanism toward said rotatable heating member at widthwise end portions thereof.

31. An image heating apparatus according to claim 30, wherein said swing supporting mechanism includes a first shaft portion configured to swingably support said first holding member and a second shaft portion configured to swingably support said second holding member, and wherein said urging mechanism includes:

a first cylindrical rotatable member rotatably supported by said first shaft portion in an end side;

a second cylindrical rotatable member rotatably supported by said second shaft portion in another end side;

a first urging member configured to urge said first cylindrical rotatable member toward said rotatable heating member in contact with said first cylindrical rotatable member; and a second urging member configured to urge said second cylindrical rotatable member toward said rotatable heating member in contact with said second cylindrical rotatable member, wherein said first and second urging members cause said first and second cylindrical rotatable members, respectively, to be rotated by the rotation of said belt unit by said rotating mechanism.

32. An image heating apparatus according to claim 25, wherein said rotatable heating member is a heating roller configured to urge the belt or a heating belt configured to be urged from an inner surface thereof toward the belt by a roller opposing the belt.

33. An image heating apparatus according to claim 25, wherein when an angle formed between a movement direction of said rotatable heating member and a movement direction of the belt at a pressing roller point of contact between said rotatable heating member and the belt is capable of being changed by said rotating mechanism to a first angle and a second angle larger in absolute value than the first angle, an absolute value of a first tilt angle formed between an axis of the first supporting roller and an axis of the second supporting roller when the angle is changed to the first angle is smaller than an absolute value of a second tilt angle formed between the axis of the first supporting roller and the axis of the second supporting roller when the angle is changed to the second angle.

34. An image heating apparatus according to claim 25, wherein said belt unit is rotated, by said rotating mechanism, about an axis located at a substantially central portion of said belt unit with respect to the widthwise direction of the belt.

35. An image heating apparatus according to claim 25, further comprising a driving mechanism configured to rotationally drive said rotatable heating member, wherein the belt is rotated by rotation of said rotatable heating member.

36. An image heating apparatus according to claim 25, wherein in each of the first and second supporting rollers, a heater is incorporated.

37. An image heating apparatus comprising:

a rotatable heating member configured to heat a toner image on a recording material;

a belt unit including an endless belt configured to heat said rotatable heating member in contact with said rotatable heating member and including first and second supporting members configured to rotatably support an inner surface of the belt and configured to urge the belt toward said rotatable heating member;

a detector configured to detect that the belt is deviated from a predetermined zone with respect to a widthwise direction of the belt;

a tilting mechanism configured to tilt, depending on an output of said detector, the belt unit in a direction for returning the belt into the predetermined zone; and a displacing mechanism for permitting displacement, with tilt of said belt unit by said tilting mechanism, of the first supporting member in a direction of equalizing forces urging the belt toward said rotatable heating member by the first supporting member at widthwise ends of the belt, and for permitting displacement, with tilt of said belt unit by said tilting mechanism, of the second supporting member in a direction of equalizing forces urging the belt toward said rotatable heating member by the second supporting member at the widthwise ends of the belt.

* * * * *